US010392838B2

(12) United States Patent
Tomaszewski

(10) Patent No.: US 10,392,838 B2
(45) Date of Patent: Aug. 27, 2019

(54) KEY CYLINDER RELEASE MECHANISM FOR VEHICLE CLOSURE LATCHES, LATCH ASSEMBLY THEREWITH AND METHOD OF MECHANICALLY RELEASING A VEHICLE CLOSURE LATCH

(71) Applicant: Magna Closures Inc., Newmarket (CA)

(72) Inventor: Kris Tomaszewski, Newmarket (CA)

(73) Assignee: MAGNA CLOSURES INC., Newmarket (CA)

( * ) Notice: Subject to any disclaimer, the term of this patent is extended or adjusted under 35 U.S.C. 154(b) by 409 days.

(21) Appl. No.: 15/176,304

(22) Filed: Jun. 8, 2016

(65) Prior Publication Data

US 2016/0362916 A1 Dec. 15, 2016

Related U.S. Application Data

(60) Provisional application No. 62/174,152, filed on Jun. 11, 2015.

(51) Int. Cl.

| | |
|---|---|
| ***E05B 81/90*** | (2014.01) |
| ***E05B 79/16*** | (2014.01) |
| ***E05B 81/06*** | (2014.01) |
| ***E05B 81/16*** | (2014.01) |
| ***E05B 81/56*** | (2014.01) |
| ***E05B 81/76*** | (2014.01) |
| ***E05B 83/36*** | (2014.01) |
| ***E05B 85/06*** | (2014.01) |
| ***E05B 85/24*** | (2014.01) |
| ***E05B 85/26*** | (2014.01) |

(Continued)

(52) U.S. Cl.

CPC ..... *E05B 81/90* (2013.01); *E05B 77/30* (2013.01); *E05B 79/16* (2013.01); *E05B 81/06* (2013.01); *E05B 81/14* (2013.01); *E05B 81/16* (2013.01); *E05B 81/56* (2013.01); *E05B 81/76* (2013.01); *E05B 81/77* (2013.01); *E05B 83/36* (2013.01); *E05B 85/06* (2013.01); *E05B 85/243* (2013.01); *E05B 85/26* (2013.01); *E05B 77/26* (2013.01); *E05B 77/28* (2013.01); *E05B 81/42* (2013.01); *E05B 81/64* (2013.01); *E05B 81/74* (2013.01)

(58) Field of Classification Search

CPC ..... E05B 81/90; E05B 77/30; E05B 79/16; E05B 81/06; E05B 81/14; E05B 81/16; E05B 871/56; E05B 81/76; E05B 81/77; E05B 83/36; E05B 85/06; E05B 85/243; E05B 85/26; E05B 77/26; E05B 77/28; E05B 81/42; E05B 81/64; E05B 81/74; E05C 3/06

USPC ..... 292/201, 216, DIG. 23; 70/279.1

See application file for complete search history.

(56) References Cited

U.S. PATENT DOCUMENTS

| | | | |
|---|---|---|---|
| 6,000,257 | A | 12/1999 | Thomas |
| 6,609,737 | B2 | 8/2003 | Fisher |

(Continued)

FOREIGN PATENT DOCUMENTS

| | | | |
|---|---|---|---|
| CA | 2214622 | A1 | 3/1999 |
| WO | WO2014102279 | A1 | 7/2014 |

*Primary Examiner* — Suzanne L Barrett

(74) *Attorney, Agent, or Firm* — Dickinson Wright PLLC

(57) ABSTRACT

A power latch assembly is disclosed having a latch mechanism, a power release mechanism for selectively releasing the latch mechanism using an electric actuator, and a key cylinder mechanical release mechanism configured to release the latch mechanism in response to two distinct user input activation movements.

16 Claims, 28 Drawing Sheets

(51) Int. Cl.

| | |
|---|---|
| ***E05B 77/30*** | (2014.01) |
| ***E05B 81/14*** | (2014.01) |
| *E05B 77/26* | (2014.01) |
| *E05B 77/28* | (2014.01) |
| *E05B 81/64* | (2014.01) |
| *E05B 81/42* | (2014.01) |
| *E05B 81/74* | (2014.01) |

(56) References Cited

U.S. PATENT DOCUMENTS

| | | | | |
|---|---|---|---|---|
| 7,036,855 | B2 | 5/2006 | Lin et al. | |
| 7,264,283 | B2 | 9/2007 | Stoof et al. | |
| 7,827,836 | B2 * | 11/2010 | Cetnar | E05B 77/26 292/201 |
| 8,141,916 | B2 | 3/2012 | Tomaszewski et al. | |
| 8,474,888 | B2 | 7/2013 | Tomaszewski | |
| 8,522,583 | B2 * | 9/2013 | Cumbo | E05B 81/06 292/201 |
| 8,562,033 | B2 | 10/2013 | Tomaszewski et al. | |
| 8,967,682 | B2 | 3/2015 | Jankowski et al. | |
| 9,938,755 | B2 * | 4/2018 | Taurasi | E05B 81/90 |
| 2003/0218340 | A1 | 11/2003 | Coleman et al. | |
| 2010/0207400 | A1 | 8/2010 | Tomaszewski et al. | |
| 2016/0017645 | A1 | 1/2016 | Tomaszewski et al. | |

* cited by examiner

KEY CYLINDER RELEASE MECHANISM FOR VEHICLE CLOSURE LATCHES, LATCH ASSEMBLY THEREWITH AND METHOD OF MECHANICALLY RELEASING A VEHICLE CLOSURE LATCH

CROSS-REFERENCE TO RELATED APPLICATION

This application claims the benefit of U.S. Provisional Application Ser. No. 62/174,152, filed Jun. 11, 2015, which is incorporated herein by reference in its entirety.

FIELD OF THE INVENTION

The present disclosure relates generally to closure latches for motor vehicles and, more particularly, to a power latch assembly equipped with key cylinder release mechanism configured to require at least two actuation inputs to permit mechanical release of the latch mechanism.

BACKGROUND OF THE INVENTION

This section provides background information related to the disclosure that is not necessarily prior art.

In the following description, the expression "closure panels" will be used to generally indicate any component or element moveable between an open position and a closed position, respectively opening and closing an access to an inner compartment of a motor vehicle. As such, the term closure member shall include, without limitation, rear hatches, tailgates, liftgates, bonnet lids, deck lids and trunk lids in addition to the side doors of a motor vehicle to which the following description makes specific reference and purely by way of example.

In view of increased consumer demand for motor vehicles equipped with advanced comfort and convenience features, many modern motor vehicles are now provided with passive entry systems to permit locking and release of closure panels (i.e., doors, tailgates, liftgates and decklids) without use of a traditional key-type entry system. In this regard, some popular features now available with vehicle latch systems include power locking/unlocking, power release and power cinching. These "powered" features are provided by a latch assembly mounted to the closure panel and which includes a ratchet and pawl type of latching mechanism controlled via at least one electric actuator. Typically, the closure panel is held in a closed position by virtue of the ratchet being positioned in a striker capture position to releaseably retain a striker that is mounted to a structural portion of the vehicle. The ratchet is held in its striker capture position by the pawl engaging the ratchet in a ratchet holding position. To release the closure panel from its closed position, the electric actuator is actuated to move the pawl from its ratchet holding position into a ratchet release position, whereby a biasing arrangement forcibly pivots the ratchet from its striker capture position into a striker release position so as to release the striker. As an alternative, it is also known to employ a double pawl type of latching mechanism to reduce the release effort required for the electric actuator to release the latching mechanism.

As is known, such electrically-operated or "power" latch assemblies must also be capable of permitting the vehicle door to be opened in the event of emergency situations, such as in the case of an accident or crash involving the motor vehicle. In particular, during a vehicle crash or other emergency situation, the vehicle doors must be kept closed independently of handle activations or other used external interventions, such power latch assemblies commonly referred to as operating in a "double locking" status. However, after the crash, the vehicle doors should be capable of being opened with the power latch assembly returning to its "unlocking" status. In some vehicles, a crash management system is employed which is configured to detect a crash situation (via crash sensors) and issue suitable control signals to the electric actuators (typically electric motors) of the power latch assembly in order to automatically shift into the double locking status during the crash situation and subsequently return to the unlocking status a certain amount of time after the crash situation. However, during such an emergency situation, failure of the vehicle's main power supply, or interruptions or breaking of the electrical connections between the main power supply and/or the crash management controller and the power latch assembly may occur. Accordingly, such power latch assemblies with a power release function, typically require one or more emergency or "backup" mechanical release mechanisms to open the vehicle closure panel in the event power is not available. One way to provide this function is to connect a key cylinder lever, by rod or cable, to a release lever at the latch mechanism which is connected (directly or indirectly) to the pawl. This solution may also protect against the effects of inertia occurring during a crash event, since the key cylinder remains in a rest position until a key is inserted and rotated.

One drawback associated with conventional mechanical release systems is that relative movement between the key cylinder and the power latch assembly may occur during the crash event. To avoid unintentional activation of the release mechanism, efforts have been directed to enhance the connection and functional interaction of the components interconnecting the key cylinder and the release lever acting on the pawl. Specifically, a need continues to exist to develop an alternative to "single" motion release lever activation configurations.

SUMMARY OF THE INVENTION

This section provides a general summary of the disclosure and is not intended to be considered an exhaustive and comprehensive listing of all of its aspects, features and objectives, nor is this summary intended to limit its scope.

It is an aspect of the present disclosure to provide a power latch assembly for a motor vehicle closure system configured to provide a power release feature and a mechanical release feature.

It is a related aspect of the present disclosure to provide the power latch assembly with a mechanical release feature configured to require at least two distinct activation movements, or a sequence of activation movements in opposite directions, to move a release link between a lock position and an unlock position relative to a release lever that is configured to move the pawl from its ratchet checking position into its ratchet release position.

It is a related aspect of the present disclosure to provide a latch assembly for a motor vehicle including a ratchet moveable between a striker release position and a striker capture position; a ratchet biasing member biasing the ratchet toward the striker release position; a pawl moveable between a ratchet checking position to hold the ratchet in the striker capture position and a ratchet release position to permit movement of the ratchet to the striker release position; a pawl biasing member biasing the pawl toward the ratchet checking position; a latch release mechanism operable in a latch lock mode to locate the pawl in the ratchet checking position and to locate the pawl in the ratchet release position in a latch release mode; a power-operated actuation mechanism operable to shift the latch release mechanism from the latch lock mode into the latch release mode; and a mechanical key cylinder release mechanism operable in a lock mode to maintain the latch release mechanism in the latch lock mode and in an unlock mode to shift the latch release mechanism into its latch release mode, the key cylinder release mechanism having a key cylinder requiring at least two distinct actuation inputs via a key to move a release link from a lock position out of operable contact with the latch release mechanism to an unlock position to operably shift the latch release mechanism into the latch release mode.

It is a related aspect of the present disclosure to provide a mechanical key cylinder release mechanism for a vehicle latch, including a key cylinder; a release link having a side with a circuitous guide slot formed therein, the circuitous guide slot including an upper guide segment and a lower guide segment; a stationary guide pin disposed in the guide slot to facilitate moving the release link between a lock position and an unlock position; and a rod operably coupling the key cylinder to the release link, the rod being moveable in a first direction in response to rotation of the key cylinder in a first direction wherein the stationary guide pin traverses one of the upper and lower guide segments and being moveable in a second direction in response to rotation of the key cylinder in a second direction opposite the first direction wherein the stationary guide pin traverses the other of the upper and lower guide segments.

It is a related aspect of the present disclosure to provide a method of unlatching a power-operated vehicle closure latch. The method includes rotating a key cylinder from a start-of-travel position in a first direction with a key and causing a release link to move from a non-coplanar relation with a latch release mechanism into coplanar relation with the latch release mechanism. Further yet, rotating the key cylinder in a second direction opposite the first direction to an end-of-travel position coinciding with the start of travel position and causing the release link to pivot the latch release mechanism, thereby causing a pawl to pivot to a ratchet release position to permit biased movement of a ratchet to a striker release position, thereby releasing a striker from the ratchet.

Further areas of applicability will become apparent from the description provided herein. This description and examples in this summary are intended for purposes of illustration only and are not intended to limit the scope of the present disclosure.

BRIEF DESCRIPTION OF THE DRAWINGS

The drawings described herein are for illustrative purposes only of selected embodiments and are not intended to limit the scope of the present disclosure. The present disclosure will now be described by way of example with reference to the attached drawings, in which.

DETAILED DESCRIPTION OF THE INVENTION

Figure 1A:
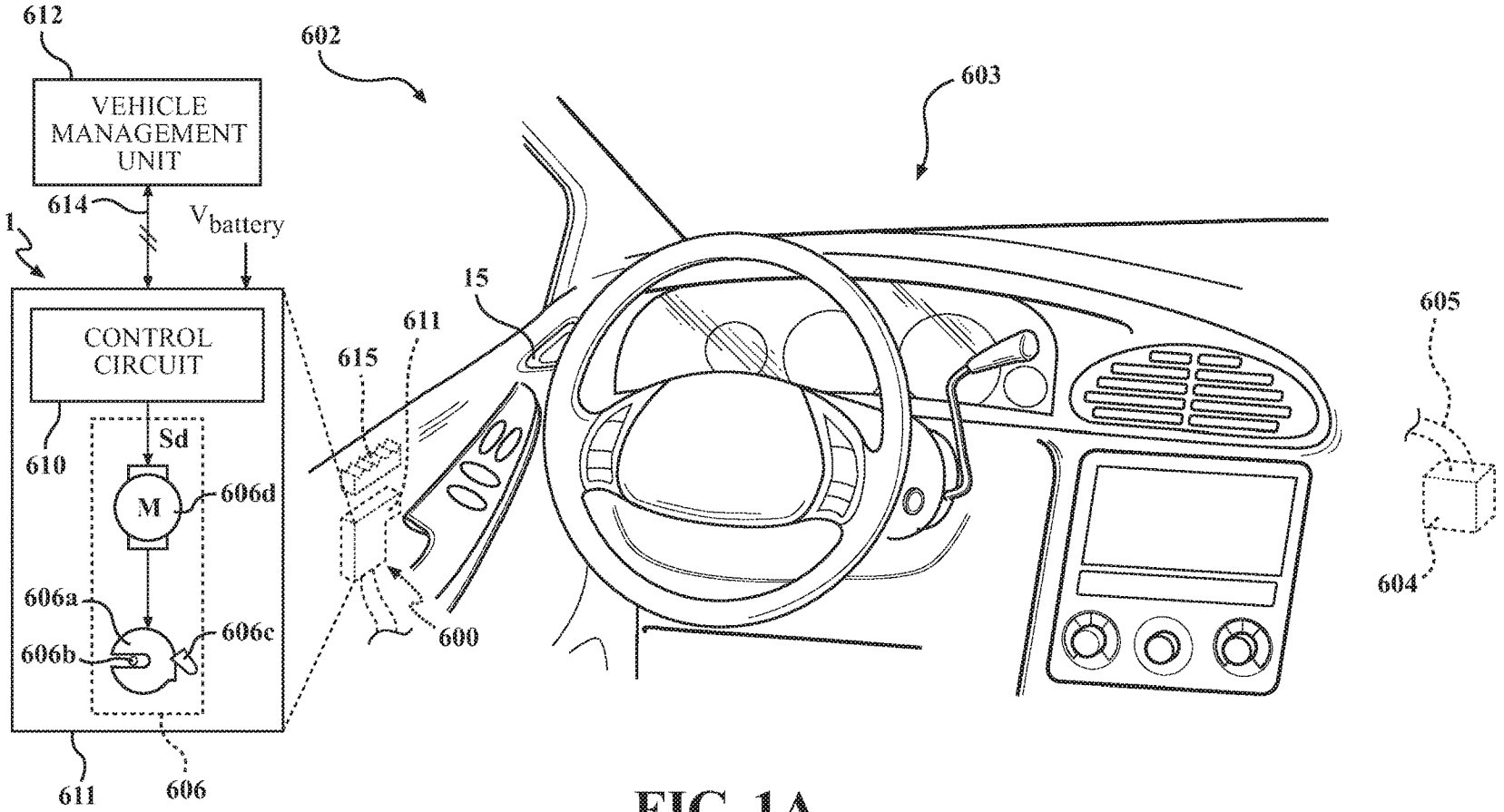
FIG. 1A is a schematic representation of a motor vehicle equipped with a closure panel and a power latch assembly.

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "compromises," "comprising," "including," and "having," are inclusive and therefore specify the presence of stated features, integers, steps, operations, elements, and/or components, but do not preclude the presence or addition of one or more other features, integers, steps, operations, elements, and/or components, but do not preclude the presence or addition of one or more other features, integers, steps operations, elements, components, and/or groups thereof. The method steps, processes, and operations described herein are no to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring initially to FIG. 1A, an electronic latch assembly, hereinafter referred to as power latch assembly or closure latch 600, is coupled to a door 602 of a motor vehicle 603. Closure latch 600 is electrically connected to a main power source 604 of motor vehicle 603 for example, a main battery providing a battery voltage ($V_{batt}$) through an electrical connection element 605, such as a power cable. Closure latch 600 is schematically illustrated to include an actuation group 606 comprised of a ratchet 606*a* which is selectably rotatable in response to engagement with a striker 606*b* that is fixed to a body portion of vehicle 603. When ratchet 606*a* is rotated in a latching direction into a striker capture position relative to striker 606*b*, door 602 is in a closed operating state. A pawl 606*c* selectively engages ratchet 606*a* to prevent it from rotating, directly or otherwise, from its striker capture position into a striker release position until door 602 is desired to be opened. An electric motor 606*d* is provided to move pawl 606*c*, directly or indirectly, from a ratchet checking position (holding ratchet 606*a* in its striker capture position) into a ratchet release position (permitting ratchet 606*a* to move into its striker release position). An electronic control circuit 610 may be conveniently arranged within a common housing 611 with actuation group 606. Electronic control circuit 610 provides control signals to electric motor 606*d* and is electrically connected to a vehicle management unit 612 via a communication path 614. An outside handle 615 is shown provided in door 602 and includes appropriate sensors (not shown) in communication with control circuit 610 to signal when a key-less entry is requested.

Figure 1B:
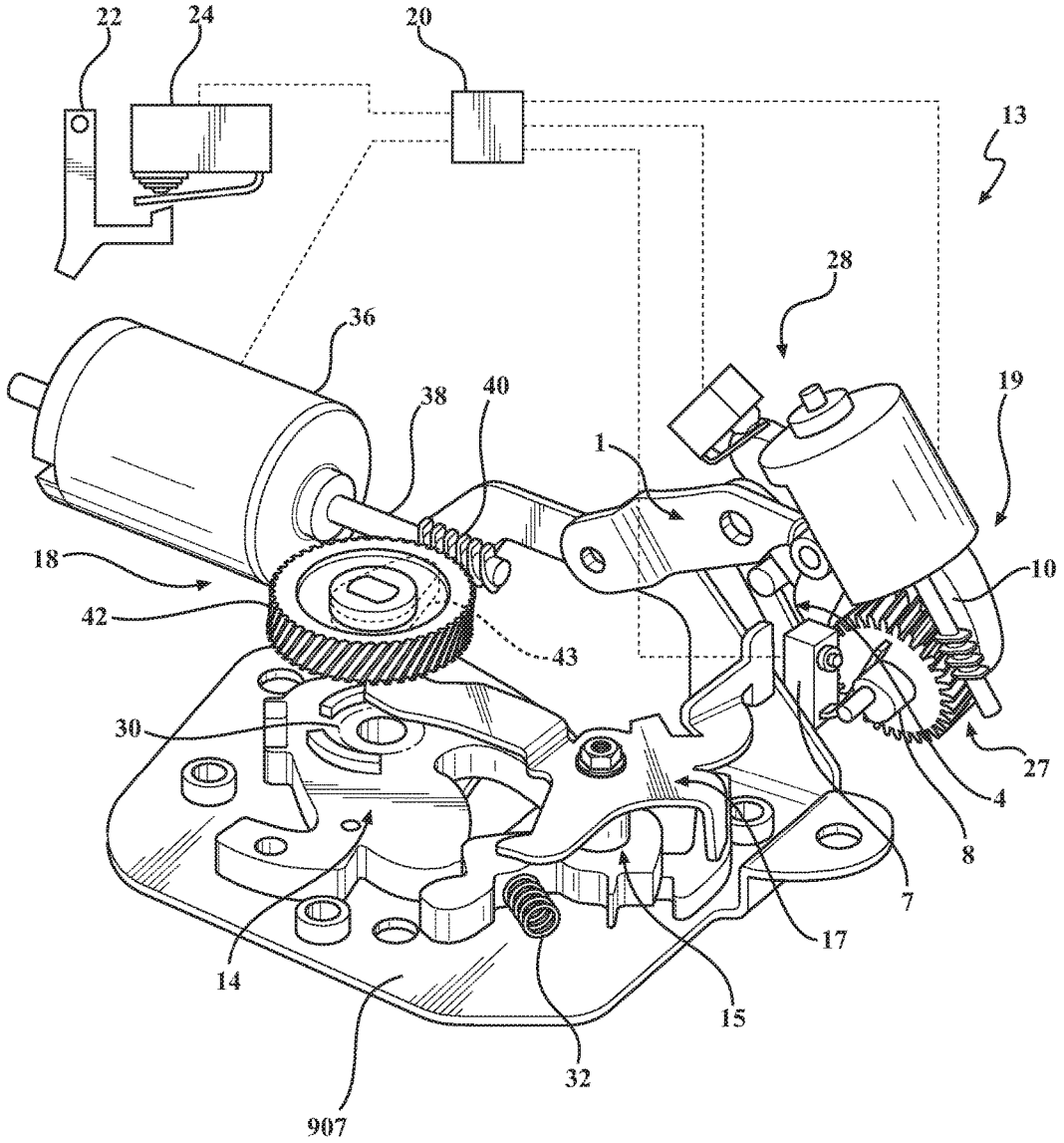
FIG. 1B is an elevation view of an embodiment of a power latch assembly.

Referring to FIG. 1B, an example of a power latch assembly 1 is disclosed as a closure latch 13 and is shown to include a ratchet 14, a pawl 15, a pawl release lever 17, an inside door release lever 1, a power release actuator 18 and a lock 27, which includes a lock mechanism 28 and a lock actuator 19. The ratchet 14 is movable between a striker capture or closed position (FIG. 1B) wherein the ratchet 14 retains the striker and a striker release or open position (FIG. 11) wherein the ratchet 14 permits release of the striker. A cover plate 907 that covers components of the closure latch 13 is shown as being transparent so as not to obscure the ratchet 14 and pawl 15. Referring to FIG. 1B, a ratchet biasing member 30, such as a torsion spring, may be provided to bias the ratchet 14 towards the open position.

The pawl 15 is movable between a ratchet checking or locking position (FIG. 1B) wherein the pawl 15 holds the ratchet 14 in the closed position, and a ratchet release position (FIG. 11) wherein the pawl 15 permits the ratchet 14 to be in the open position. A pawl biasing member 32, such as a suitable spring, may be provided to bias the pawl 15 towards the ratchet locking position.

The pawl release lever 17 is operatively connected to the pawl 15 and is movable between a pawl release position wherein the pawl release lever 17 moves the pawl 15 to the ratchet release position, and a home position (FIG. 1B) wherein the pawl release lever 17 permits the pawl 15 to be in the ratchet locking position.

A release lever biasing member, such as a suitable spring, may be provided to bias the pawl release lever 17 to the home position.

The pawl release lever 17 may be moved to the pawl release position by several components, such as, for example, by the power release actuator 18, by the inside door release lever 1, or by an outside door release lever.

The power release actuator 18 includes a power release actuator motor 36 having a power release actuator motor output shaft 38, a power release worm gear 40 mounted on the output shaft 38, and a power release driven gear 42. A power release cam 43 is connected for rotation with the driven gear 42 and is rotatable between a pawl release range of positions and a pawl non-release range of positions. In FIG. 1B, the power release cam 43 is a position that is within the pawl non-release range. The driven gear 42 is driven by the worm gear 40 and in turn drives the cam 43 which drives the pivoting of the pawl release lever 17 between the home and pawl release positions.

The power release actuator 18 may be used as part of a passive entry feature. When a person approaches the vehicle with an electronic key fob and opens the outside door handle 22, the vehicle senses both the presence of the key fob and that the door handle has been actuated (e.g. via communication between a switch 24 and an electronic control unit (ECU) shown at 20 that at least partially controls the operation of the closure latch 13). In turn, the ECU 20 actuates the power release actuator 18 to open the closure latch 13, so as to open the vehicle door.

Figure 2A:
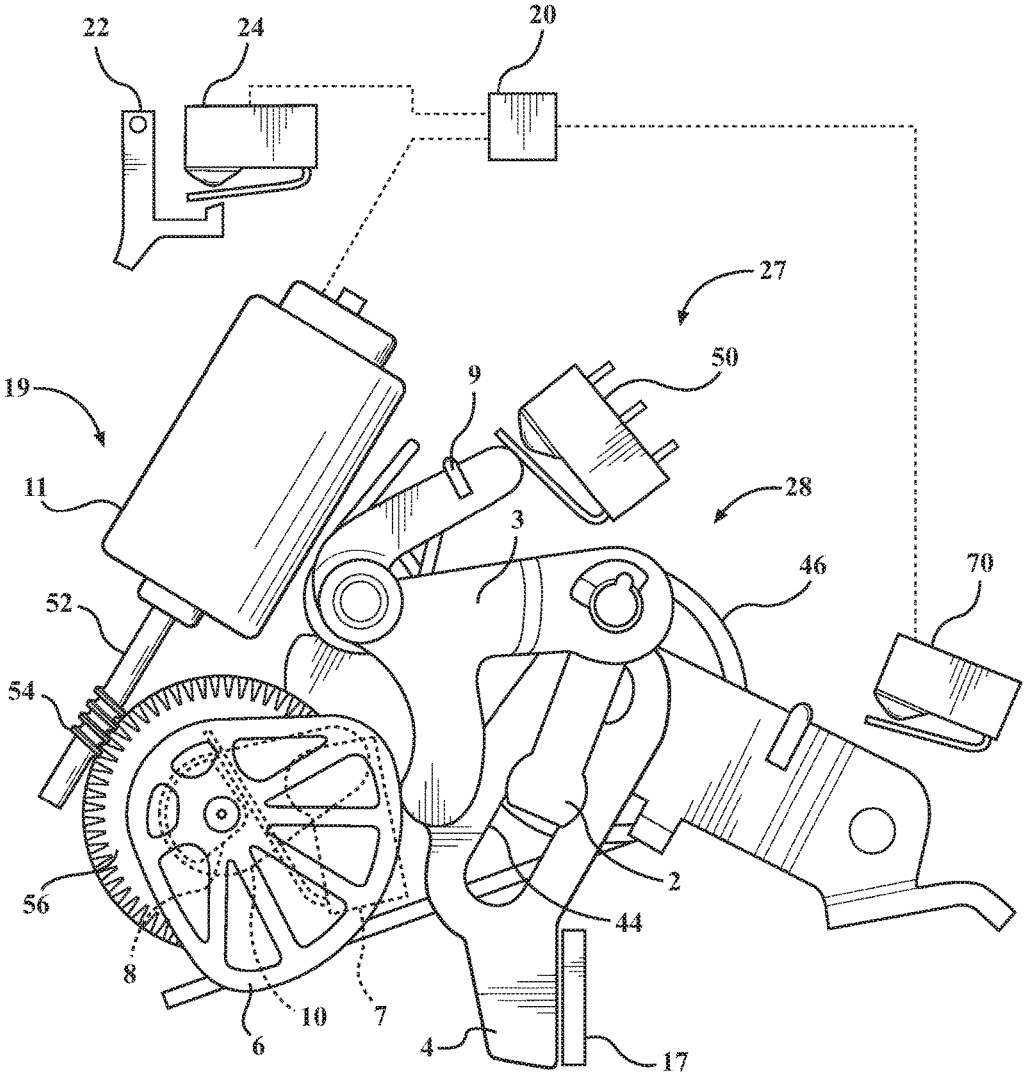
FIG. 2A is a plan view of a lock mechanism that is part of the power latch assembly shown in FIG. 1B, in a locked state.

The lock 27 controls the operative connection between the inside door release lever 1 and the pawl release lever 17. Referring to FIG. 2A, the lock mechanism 28 includes an auxiliary release lever 4, a lock link 2 and a lock lever 3. The auxiliary release lever 4 is operatively connected to the pawl release lever 17, and is movable between a home position (shown in FIG. 2A) wherein the auxiliary release lever 4 permits the pawl release lever 17 to be in the home position, and a pawl release position wherein the auxiliary release lever 4 moves the pawl release lever 17 to the pawl release position.

Figure 11:
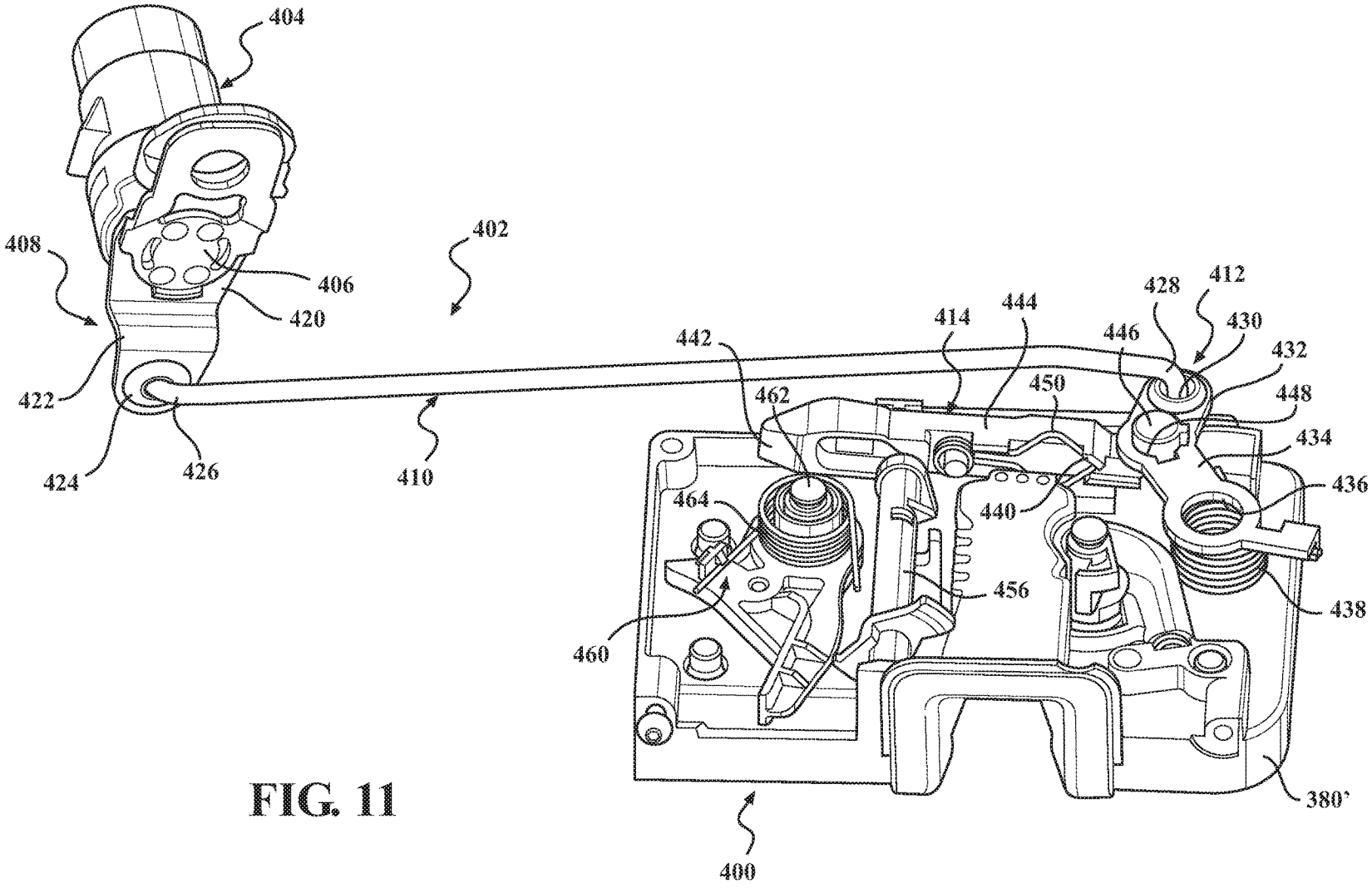
FIG. 11 is an isometric view of a key-type mechanical release mechanism adapted for integration with one or more of the power latch assemblies shown in FIGS. 1-10.

The lock link 2 is slidable within a slot 44 in the auxiliary release lever 4 and controls the connection between the inside door release lever 1 and the auxiliary release lever 4. The lock link 2 is movable between a locked position (FIG. 2A) and an unlocked position (FIG. 2C). When the lock link 2 is in the unlocked position, the lock link 2 is positioned in the path of the inside door release lever 1 from a home position (FIG. 2A) to an actuated position (not shown). As a result, when the inside door release lever 1 is moved from the home position to the actuated position, the inside door release lever 1 engages and moves the lock link 2 and as a result the movement causes the auxiliary release lever 4 to rotate from the home position to the pawl release position (FIG. 11). When the lock link 2 is in the locked position (FIG. 2A), the lock link 2 is not in the path of the inside door release lever 1. As a result, movement of the inside door release lever 1 from the home position to the actuated position does not result in any corresponding movement of the auxiliary release lever 4 away from the home position.

The lock lever 3 is operatively connected to the lock link 2 and is movable between a locked position (FIG. 2A) wherein the lock lever 3 positions the lock link 2 in the locked position, and an unlocked position (FIG. 2C) wherein the lock lever 3 positions the lock link 2 in the unlocked position.

An inside door release lever biasing member 46, such as a suitable spring, may be provided to bias the inside door release lever 1 to the home position. A lock lever biasing member 9, such as a suitable spring, may be provided to bias the lock lever 3 to the unlocked position.

The lock actuator 19 controls the position and operation of the lock mechanism 28. The lock actuator 19 includes a lock actuator motor 11 which has a lock actuator motor output shaft 52 with a lock actuator worm gear 54 thereon, a lock actuator driven gear 56, a lock lever cam 6, an override member 10, a lock lever cam state switch cam 8 and a lock lever cam state switch 7. The lock lever cam 6, the inside door release lever cam 10 and the lock lever cam state switch cam 8 are all fixed together and rotatable with the driven gear 56. The override member 10, the switch cam 8 and the switch 7 are shown in dashed outline in FIGS. 2A-2D as a result of being obstructed from view by lock lever cam 6. The cam 8 and switch 7 are shown in FIG. 1B, however.

The lock lever cam 6 is operatively connected to the lock lever 3, and is rotatable between a locking range of positions and an unlocking range of positions. When in a position that is within the locking range of positions (examples of which are shown in FIGS. 2A and 2D), the lock lever cam 6 holds the lock lever 3 in the locked position. When in a position that is within the unlocking range of positions (an example of which is shown in FIG. 2C), the lock lever cam 6 permits the lock lever 3 to move to the unlocked position.

The lock lever cam state switch cam 8 is movable between an unlocking range of positions (an example of which is shown in FIG. 2C), and a locking range of positions (an example of which is shown in FIG. 2A). Movement of the lock lever cam state switch cam 8 between the unlocking and locking ranges changes the state of the lock lever cam state switch 7. For example, the switch 7 may be open when the lock lever cam state switch cam 8 is in the locking range and may be closed when the lock lever cam state switch cam 8 is in the unlocking range, or vice versa. The state of the lock lever cam state switch 7 may be used by the ECU 20 to determine whether or not to permit the outside door handle 22 to be operatively connected to the pawl release lever 17 (via the power release actuator 18 shown in FIG. 1B). It will be noted that it is alternatively possible for the operation of the switch 7 to be reversed and for the profile of the lock lever cam state switch cam 8 to be reversed, such that opening of the switch 7 would indicate to the ECU 20 that the lock 27 was unlocked, and closing of the switch 7 would indicate to the ECU 20 that the lock 27 was locked.

A lock lever state switch 50 can be used to indicate to the ECU 20, the state of the lock lever 3 (i.e. whether the lock lever 3 is in the locked or unlocked position). It will be understood that the lock lever state switch 50 is an alternative switch that can be provided instead of the switch 7 and switch cam 8. In other words, if the switch 50 is provided, the switch 7 and cam 8 may be omitted. Alternatively if the switch 7 and cam 8 are provided, the switch 50 may be omitted.

The override member 10 is movable between an actuatable range of positions (an example of which is shown in FIG. 2A), and a non-actuatable range of positions (examples of which are shown in FIGS. 2C and 2D). The operation of the override member 10 is described further below.

Rotation of the lock actuator motor 11 drives the rotation of the driven gear 56 (through the worm gear 54) and therefore drives the movement of the lock lever cam 6, the lock lever cam state switch cam 8 and the inside door release lever cam 10.

For a rear door application, the lock 27 may have three lock states: locked (FIG. 2A), unlocked (FIG. 2C), and child-locked (FIG. 2D).

Referring to FIG. 2C, when the lock 27 is in the unlocked state, the lock lever cam 6 is within the unlocking range and as a result, the lock lever 3 and lock link 2 are in their unlocked positions. As a result, the inside door release lever 1 is operatively connected to the pawl release lever 17 (and therefore to the pawl 15 shown in FIG. 1B) through the lock link 2 and the auxiliary release lever 4. Thus, actuation of the inside door release lever 1 to the actuated position results in the actuation of pawl release lever 17 and thus movement of the pawl 15 to the ratchet release position (FIG. 11), thereby releasing the ratchet 14. Additionally, referring to FIG. 2C, the lock lever cam state switch cam 8 is in the unlocking range so as to indicate to the ECU 20 to consider the outside door handle 22 as unlocked. As a result, if the outside door handle 22 were pulled by a person outside the vehicle even if the person does not possess the electronic key fob or a key, the power release actuator 18 (FIG. 1B) actuates the pawl release lever 17 so as to open the vehicle door.

The lock 27 shown in FIGS. 2A-2D includes a double pull override feature that permits the inside door release lever 1 to open the vehicle door even if the lock 27 is in the locked position. Referring to FIG. 2A, when the lock 27 in the locked position the lock lever cam 6 is in the locking range and thus holds the lock lever 3 in the locked position against the urging of the lock lever biasing member 9. Furthermore, the lock lever cam state switch cam 8 is in the locking range and as a result, the lock lever cam state switch 7 indicates to the ECU 20 that the lock 27 is locked so that the ECU 20 operatively disconnects the outside door handle 22 from the pawl release lever 17. Furthermore, the override member 10 is in the actuatable range.

When the inside door release lever 1 is actuated (i.e. moved to the actuated position) while the lock 27 is in the locked position (see FIG. 2B), the inside door release lever 1 does not move the auxiliary release lever 4 to the pawl release position. The movement of the inside door release lever 1 does, however, drive the override member 10 to move from a first position which is an actuatable position, to a second position which is in the non-actuatable range. Because the lock lever cam 6, the lock lever cam state switch cam 8 and the override member 10 are all connected together, the movement of the override member 10 to the second position (FIG. 2B) results in movement of the lock lever cam 6 to a position within the unlocking range and results in movement of the lock lever cam state switch cam 8 to a position within the unlocking range. The movement of the lock lever cam state switch cam 8 to within the unlocking range closes the lock lever cam state switch 7 so as to signal to the ECU 20 to permit operative control between the outside door handle 22 and the pawl release lever 17.

While the inside door release lever 1 is still actuated, a lock link keeper surface 58 optionally provided thereon holds the lock link 2 in the locked position. As a result, the lock lever 3 remains in the locked position even though the lock lever cam 6 no longer obstructs the movement of the lock lever 3 to the unlocked position. The respective states of the lock lever cam state switch 7 and the lock lever state switch 50 can be used to indicate to the ECU 20 that the lock 27 is in an 'override' state.

When the inside door release lever 1 is released from the actuated position and moves back to the home position (see FIG. 2C), the keeper surface 58 (shown in FIG. 2B) moves out of the way of the lock link 2, and so the lock link 2 and the lock lever 3 move to their unlocked positions under the urging of the lock lever biasing member 9 (FIG. 2C). As a result, the lock 27 is in the unlocked state. Thus, when the lock 27 was in the locked state, actuation and return to the home position of the inside door release lever 1 has moved the lock 27 to the unlocked state shown in FIG. 2C, wherein the inside door release lever 1 is operatively connected to the pawl release lever 17 through the lock link 2 and the auxiliary release lever 4. As a result, a second actuation of the inside door release lever 1 actuates the pawl release lever 17 so as to release the pawl 15 (FIG. 1B) and open the vehicle door 900 (FIG. 11).

When the lock 27 is in the child-locked state, shown in FIG. 2D, the lock lever cam 6 is in the locking range, and as a result the lock link 2 and lock lever 3 are in their locked positions. Furthermore, the override member 10 is in a third position, which is in the non-actuatable range. As a result, the inside door release lever 1 is prevented from overriding the lock 27 and opening the vehicle door regardless of how many times the release lever 1 is actuated. Furthermore, the lock lever cam state switch cam 8 may be in the locking range, thereby resulting in the operative disconnection between the outside door handle 22 and the pawl release lever 17.

The lock 27 may be positionable in the unlocked, locked and child-locked positions by the lock actuator 19. More specifically, to move the lock 27 from the locked state (FIG. 2A) to the unlocked state (FIG. 2C) the lock actuation motor 11 may be actuated to rotate the driven gear 56 in a first direction (clockwise in the view shown in FIG. 2A) until the ECU 20 senses that the lock lever cam state switch cam 8 has moved to the unlocking range based on the state of the switch 7 and that the lock lever cam 6 has moved to the unlocking range based on the state of the switch 50. To move the lock 27 from the unlocked state (FIG. 2C) to the child-locked state (FIG. 2D) the lock actuation motor 11 may be actuated to rotate the driven gear 56 in the first direction (clockwise in the view shown in FIG. 2C) until the lock actuation motor 11 stalls as a result of engagement with a component connected to the driven gear 56 with a corresponding limit surface. To move the lock 27 from the locked state (FIG. 2A) to the child-locked state (FIG. 2D) the lock actuation motor 11 may be actuated to rotate the driven gear 56 in the first direction (clockwise in the view shown in FIG. 2A) until the lock actuation motor 11 stalls as a result of engagement with a component connected to the driven gear 56 with a corresponding limit surface.

To move the lock 27 from the child-locked state (FIG. 2D) to the unlocked state (FIG. 2C) the lock actuation motor 11 may be actuated to rotate the driven gear 56 in a second direction (counter-clockwise in the view shown in FIG. 2D) until the ECU 20 senses that the lock lever cam state switch cam 8 has moved to the unlocking range based on the state of the switch 7, and that the lock lever cam 6 has moved to the unlocking range based on the state of the switch 50. To move the lock 27 from the unlocked state (FIG. 2C) to the locked state (FIG. 2A) the lock actuation motor 11 may be actuated to rotate the driven gear 56 in the second direction (counter-clockwise in the view shown in FIG. 2C) until the lock actuation motor 11 stalls as a result of engagement with a component connected to the driven gear 56 with a corresponding limit surface. To move the lock 27 from the child-locked state (FIG. 2D) to the locked state (FIG. 2A) the lock actuation motor 11 may be actuated to rotate the driven gear 56 in the second direction (counter-clockwise in the view shown in FIG. 2D) until the lock actuation motor 11 stalls as a result of engagement with a component connected to the driven gear 56 with a corresponding limit surface.

During the aforementioned movements of the lock components, the lock state can be indicated to the ECU 20 by state of the lock lever cam state switch 7 and additionally in some cases by the most recent command issued by the ECU 20 to the lock actuation motor 11. More specifically, if the switch 7 indicates a locked state, and the most recent command by the ECU 20 was to rotate the motor 11 in the first direction, then the lock 27 is in the child-locked state. If the switch 7 indicates a locked state and the most recent command by the ECU 20 was to rotate the motor 11 in the second direction, then the lock 27 is in the locked state. If the switch 7 is indicates an unlocked state, then the lock 27 is in the unlocked state regardless of the most recent command issued by the ECU 20 to the motor 11. It will be noted that the lock state of the lock 27 could alternatively be determined by the state of the lock lever state switch 50 instead of the state of the switch 7.

Figure 2B:
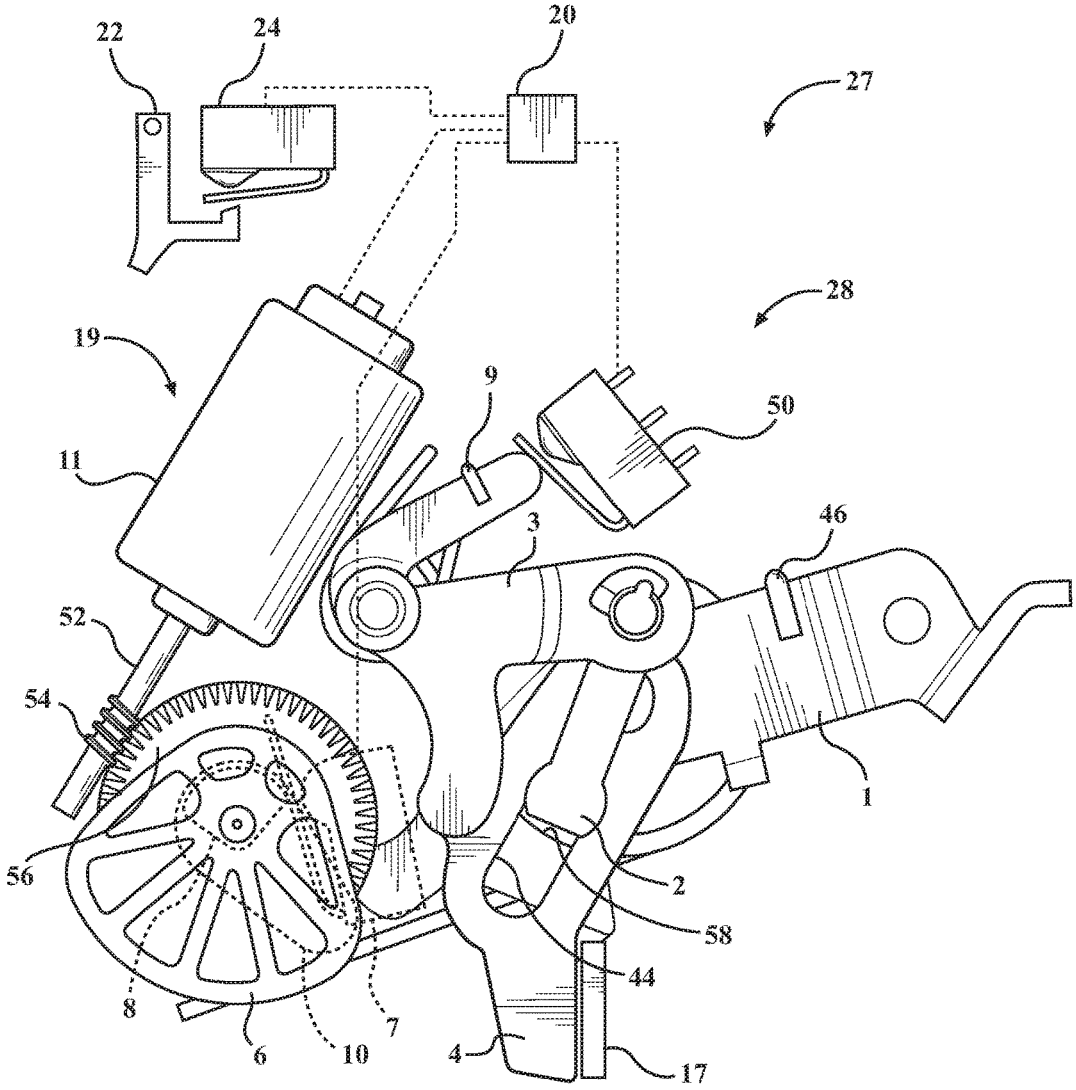
FIG. 2B is a plan view of the lock mechanism shown in FIG. 2A, in an override state.
Figure 2C:
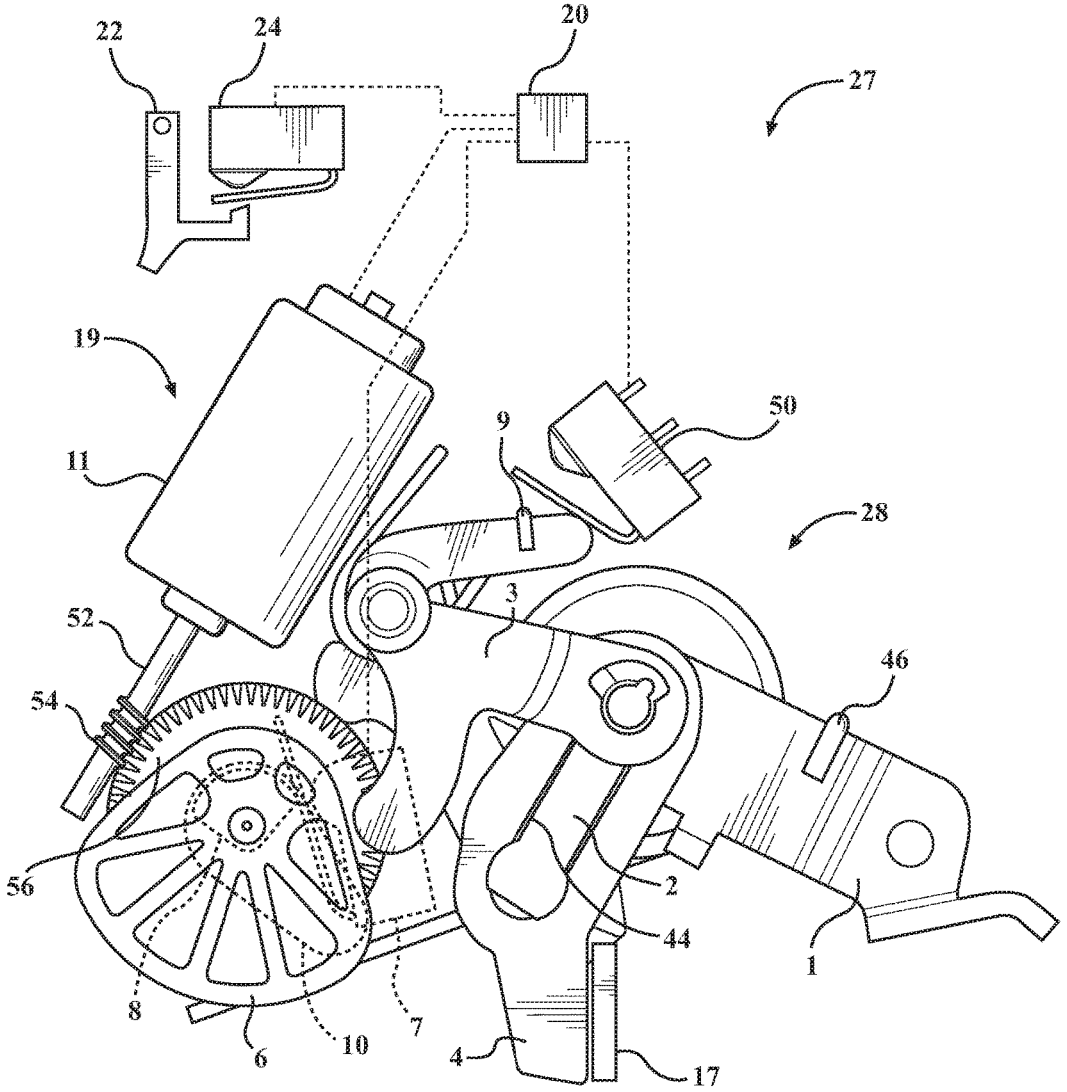
FIG. 2C is a plan view of the lock mechanism shown in FIG. 2A, in an unlocked state.
Figure 2D:
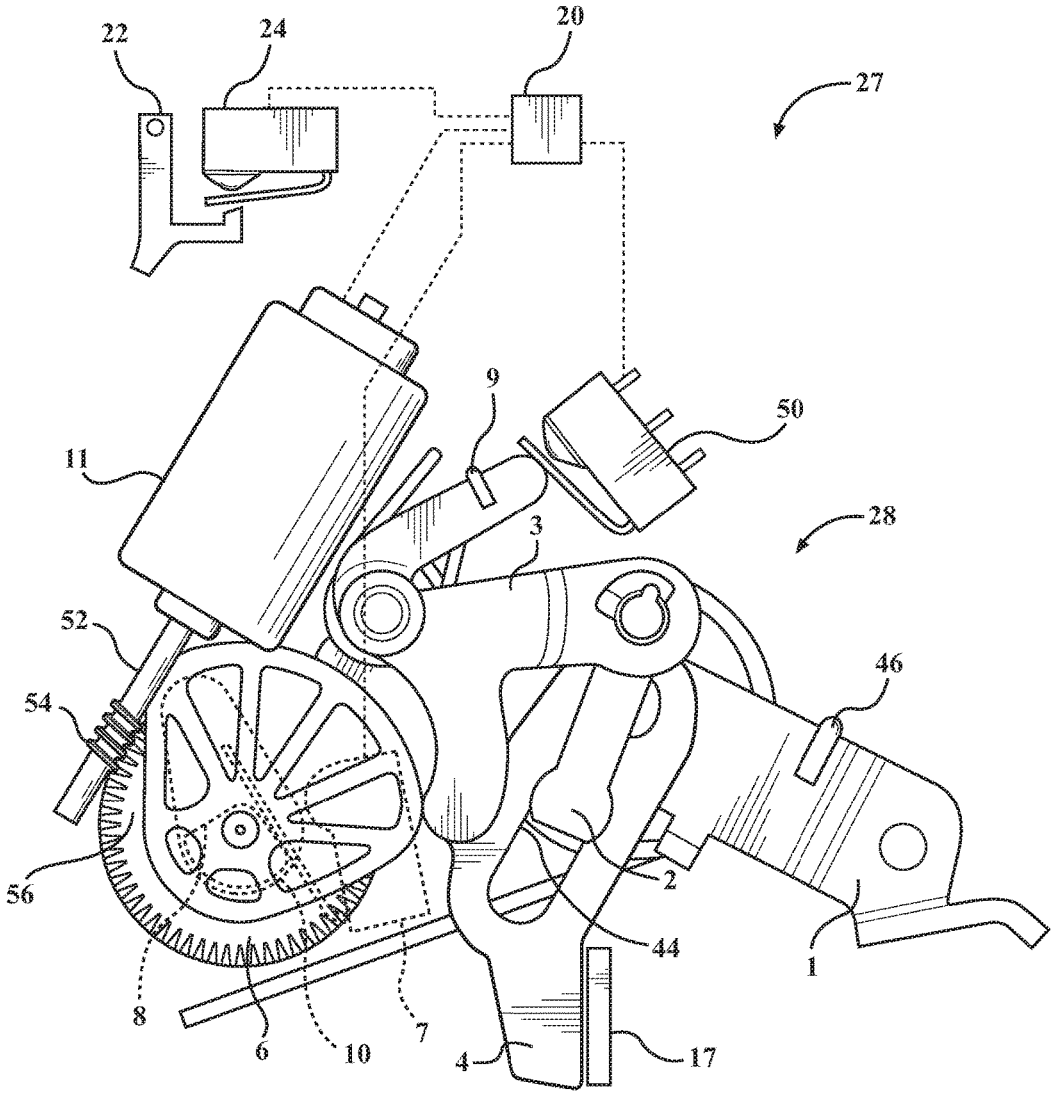
FIG. 2D is a plan view of the lock mechanism shown in FIG. 2A, in a child-locked state.

The lock 27 shown in FIGS. 2A-2D includes a 'panic' feature, which permits the lock state to be changed from the child-locked state (FIG. 2D) to the unlocked state (FIG. 2C), while the inside door release lever 1 is in the actuated position (FIG. 2B). Because the keeper surface 58 on the inside door release lever 1 keeps the lock lever 3 in the locked position, the lock lever 3 does not obstruct the movement of the lock lever cam 6 counter-clockwise to the unlocking range. As a result, when the inside door release lever 1 is released and moves back to the home position, the lock lever 3 can move to the unlocked position, and the lock 27 at that point will be in the unlocked state. Thus, the lock 27 permits the closure latch 13 to receive and act upon an instruction to unlock, even when a vehicle occupant has actuated the inside door release lever 1 and hold the release lever 1 in the actuated position.

In the child-locked state, the lock 27 does not permit the inside door release lever 1 to be able to open the closure latch 13, but the lock 27 may permit the inside door release lever 1 to unlock the outside door handle 22, so that the outside door handle 22 can subsequently be used to open the closure latch 13. To achieve this, an inside door release lever state switch shown at 70 may be provided for indicating to the ECU 20 the state of the inside door release lever (i.e. for indicating to the ECU 20 whether the inside door release lever 1 is in the home position or the actuated position). When the inside door release lever 1 is actuated, the ECU 20 can sense the actuation and if the lock 27 is in the child-locked state, the ECU 20 can unlock the outside door handle 22. When the inside door release lever 1 is actuated while the lock 27 is in the double-locked state, the ECU 20 would not unlock the lock link 2 or the outside door handle 22.

Instead of the motor 11 being capable of turning the driven gear 56 to a selected position associated with the child-locked state of the lock 27, it is alternatively possible for movement of the lock 27 into and out of the child-locked state to be manually controlled, (e.g. via a child lock mechanism that includes a lever that protrudes from an edge face of the vehicle door 900 (FIG. 11). In such an embodiment, the child lock mechanism may include a separate child lock cam that engages a suitable part of the lock lever 3 to control whether the lock lever 3 is movable to the unlocked position. The child lock cam may be rotatable between a locking range of positions and a non-locking range of positions.

Because the child locking capability is provided from the child lock mechanism, the ECU 20 can operate the motor 11 between two positions instead of three positions. The two positions would correspond to an unlocked state of the outside door hand lock 27 and, for example, a locked state.

Figure 4:
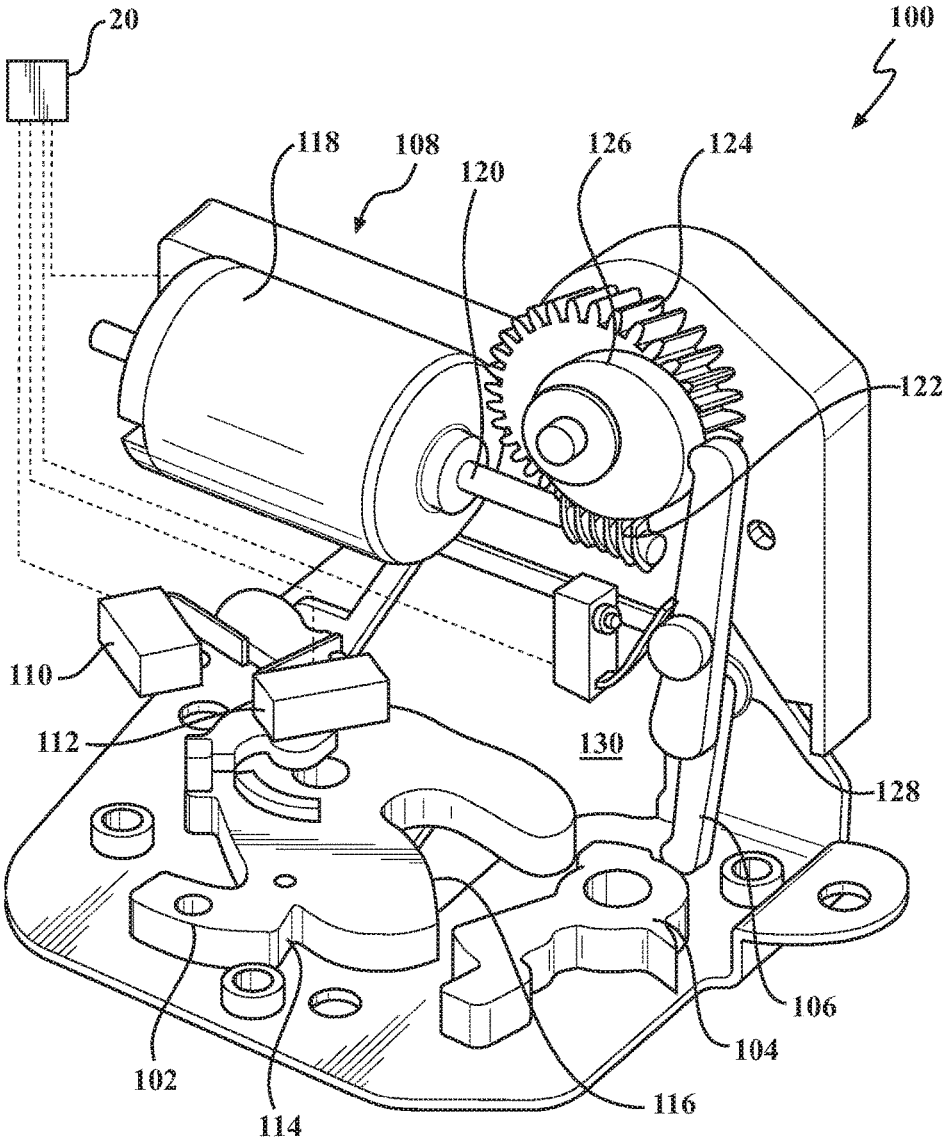
FIG. 4 is a perspective view of another embodiment of a power latch assembly.

Reference is made to FIG. 4, which shows another embodiment of a closure latch 100. The closure latch 100 includes a ratchet 102, a pawl 104 (which may be similar to the ratchet 14 and pawl 15 in FIG. 1B and which may be biased to the open position for the ratchet and to the ratchet locking position for the pawl by suitable biasing members), a pawl release lever 106 and a power release actuator 108. The ratchet 102 may have structure thereon for tripping two switches, shown at 110 and 112. The first switch 110 may be a door-ajar indicator switch, which is positioned to indicate a condition where the ratchet 102 is in the secondary position (i.e. where the pawl 104 holds the secondary locking surface, shown at 114 of the ratchet 102 instead of holding the primary locking surface 116). The second switch 112 may be used to indicate that the ratchet 102 is open (thereby indicating that the vehicle door is open).

The power release actuator 108 may include a power release actuator motor 118 with an output shaft 120 with a worm gear 122 thereon, which drives a driven gear 124. The driven gear 124 has a release lever actuation cam 126 connected thereto which pivots the pawl release lever 106 from a home position to a pawl release position (FIG. 4). A release lever biasing member 128 may be provided to bias the pawl release lever 106 towards its home position.

When the power release actuator 108 is used to release the pawl 104 to open the vehicle door, the ECU 20 may run the motor 118 until the ECU 20 receives a signal that the vehicle door is open (from switch 112), or until a selected time period has elapsed, indicating that the vehicle door is stuck (e.g. from snow or ice buildup on the vehicle). Upon receiving a signal from the door state switch that the vehicle door is open, the ECU 20 can send a signal to the motor 118 to reset the ratchet 102 and pawl 104 so that the pawl 104 is ready to lock the ratchet 102 when the vehicle door is closed.

The ECU 20 may receive signals from an inside door handle state switch (not shown in FIG. 4) and from the outside door handle state switch 24 which indicate to the ECU 20 whether either of the inside door handle (shown at 908 in FIG. 11) and the outside door handle 22 is in the home position or is actuated. The ECU 20 can provide any of several lock states including child-locked, unlocked, double-locked and locked, by selectively acting upon or ignoring actuation signals from the inside door handle and/or the outside door handle 22. These lock states may be logical states of the ECU 20. Functions such as double-pull override can be provided, whereby the ECU 20 unlocks the inside door handle upon a first actuation of the inside door handle (while the latch is locked).

A pawl release lever state switch 130 may be provided that senses the position of the pawl release lever 106. The state switch 130 can be used to indicate to the ECU 20 when the pawl release lever 106 has reached the actuated position.

The closure latch 13 described above has been described in the context of being used in a rear door of a vehicle. The closure latch 13 may also be used as shown in FIGS. 1 and 2A-2D in a front door of a vehicle having three lock states, including a locked state, an unlocked state and a double-locked state (instead of the child-locked state used in a rear door application). These three lock states may be provided by the similar structure that provided the three lock states (locked, unlocked and child-locked) for the closure latch 13 shown in FIGS. 1 and 2A-2D. One difference is that, when the lock 27 is in the double-locked state, the ECU 20 would not unlock the outside door handle 22 when the inside door release lever 1 is actuated, whereas the ECU 20 may be programmed to unlock the outside door handle 22 as described above when in the child-locked state in a rear door application.

With reference to 2A, it is optionally possible to provide an additional double lock feature for the closure latch 13.

Thus, the lock 27 (and therefore the closure latch 13) would have a child-locked state, an unlocked state and a locked state and a double-locked state.

Figure 3:
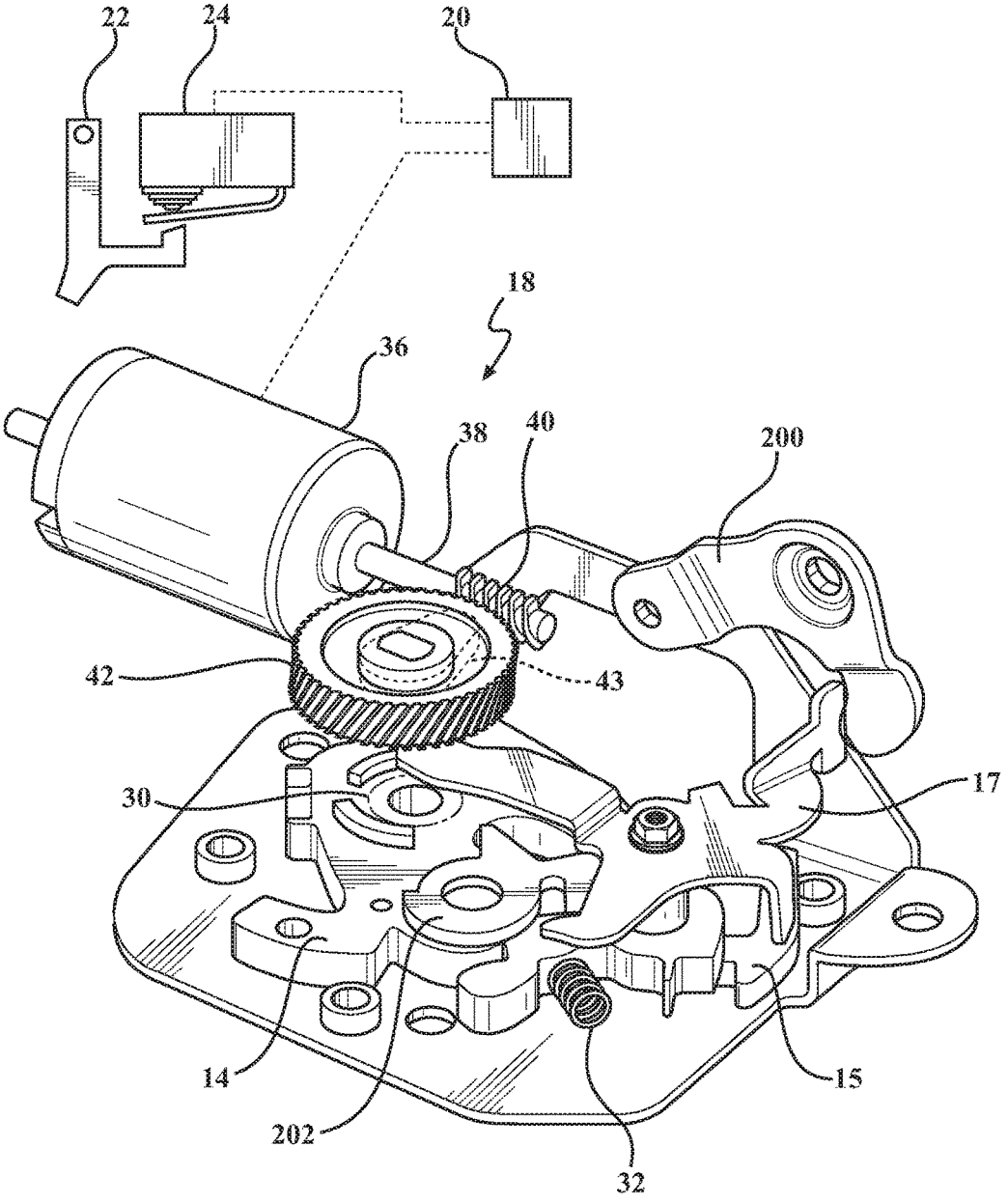
FIG. 3 is a perspective view of another embodiment of a power latch assembly.

Another example of a configuration for the closure latch 13 for a front door application is shown in FIG. 3. The closure latch 13 in FIG. 3 may include a lock (not shown) that has a locked state and an unlocked state, and that does not have a child-locked state. In the locked state, the lock disables the outside door handle 22. In the unlocked state, the lock permits actuation of the pawl release lever 17 by the outside door handle 22 through the power release actuator 18. The closure latch 13 in FIG. 3 may lack a double-pull override feature, permitting instead the direct actuation of the pawl release lever 17 by the inside door release lever, shown at 200, without regard as to whether or not the lock (not shown) is in the locked state. Optionally, the vehicle door 900 (FIG. 11) may include a key lock, which includes a key cylinder that is rotated using a key. In such an instance, an outside door release lever 202 may be provided, which is mechanically operatively connected to the pawl release lever 17 and which is itself mechanically actuated by rotation of the key cylinder.

The closure latch 13 can be configured to provide two lock states instead of three. For example, in a front door application, the closure latch may have a double-locked state and an unlocked state. In such a configuration, the override member 10 is not needed and may be omitted, because in the double-locked state, the inside door release lever 1 cannot be used to override the lock. Furthermore, the closure latch 13 may be configured so that the unlocked state represents a limit of travel for the driven gear 56 instead of corresponding to an intermediate position between two travel limits. As a result, the motor 11 can be rotated in a first direction until the motor 11 stalls to move the lock to the double-locked state, and can be rotated in a second direction until the motor 11 stalls to move the lock to the unlocked state.

In yet another variation, the closure latch 13 may be used in a front door application with two lock states: locked and unlocked, wherein the double pull override feature is provided as a way of moving the latch 13 out of the locked state. In this variation, the override member 10 is provided and can is engageable by the inside door release lever 1 to bring the latch 13 to the unlocked state, so that a subsequent actuation of the inside door release lever 1 will open the latch 13. The unlocked state can, in this variation, be at one limit of travel for the driven gear 56, while the locked state can be at the other limit of travel for the driven gear 56, so that when the motor 11 is used to change the lock state, the driven gear 56 is moved in one direction or the other until the motor 11 stalls.

Figure 5A:
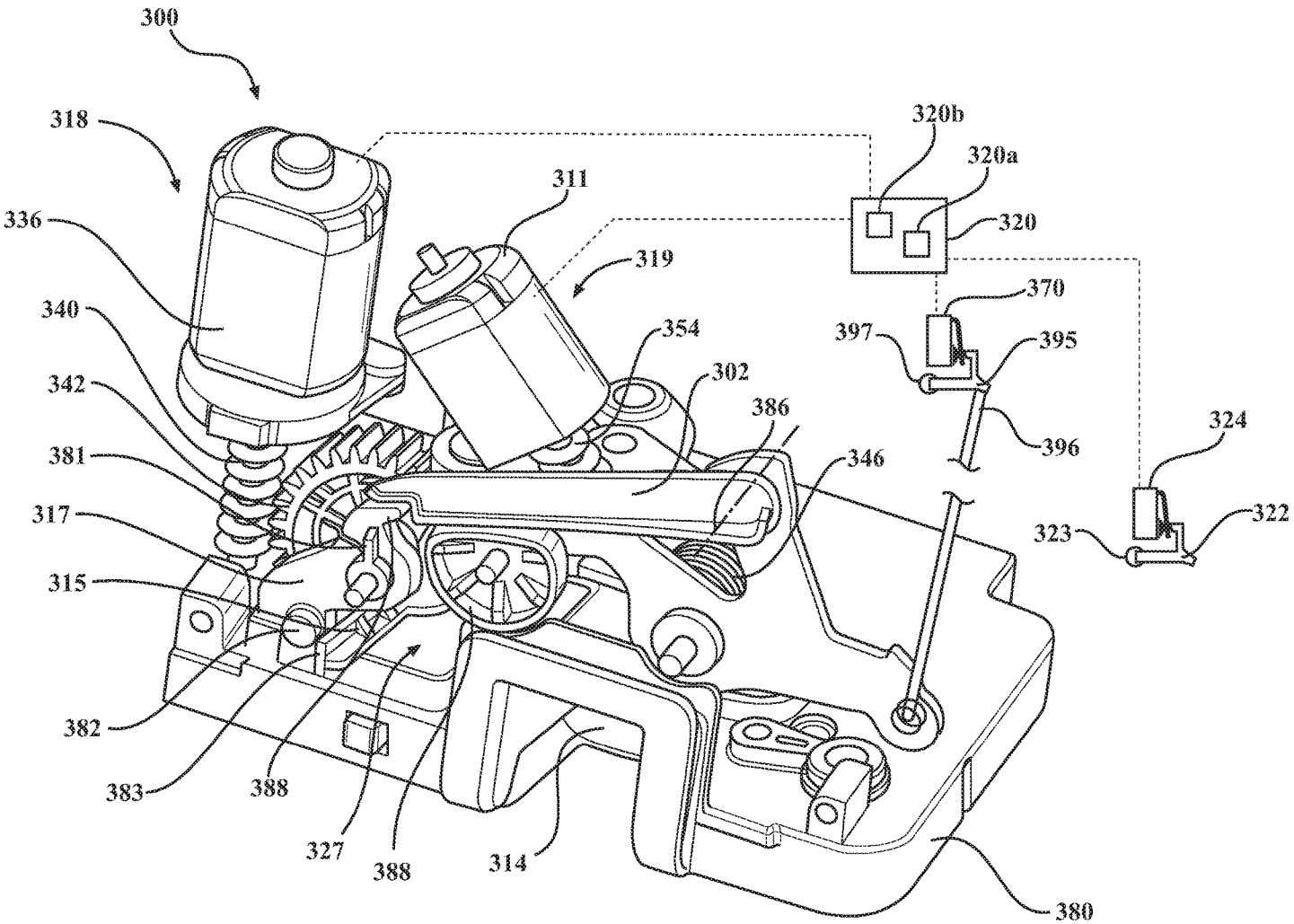
FIGS. 5A and 5B are perspective views of another embodiment of a power latch assembly.
Figure 5B:
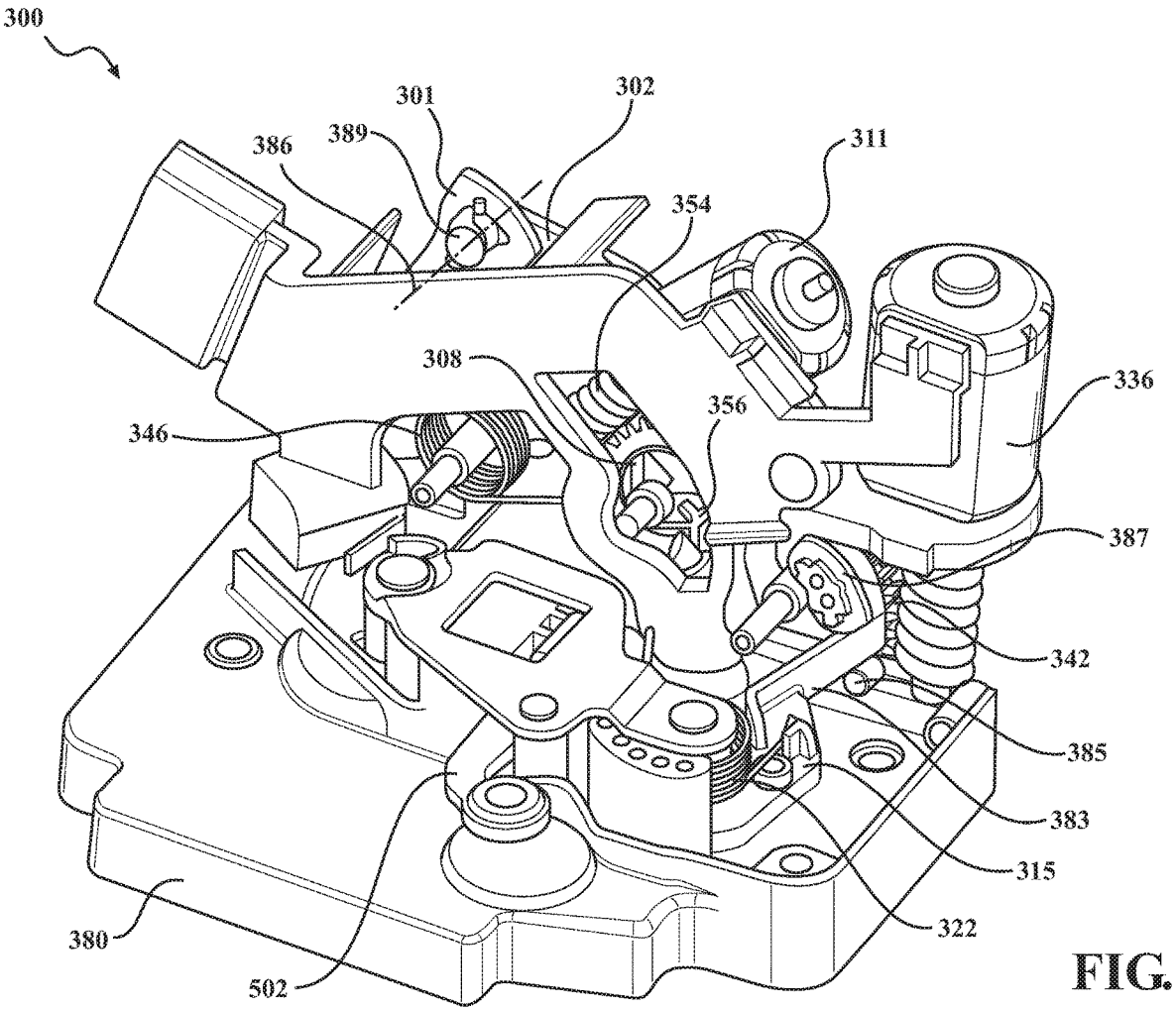

Reference is made to FIGS. 5A and 5B, which show another embodiment of a closure latch 300. In this embodiment, elements that are similar to elements shown in FIGS. 1-4 are provided with similar reference numbers. Thus, element 301 is similar to element 1 in FIGS. 1-4; element 302 is similar to element 2 in FIGS. 1-4; element 311 is similar to element 11 in FIGS. 1-4, and so on. The closure latch 300 may be similar to the closure latch 13, but may incorporate a fewer components which may provide reduced complexity and cost and increased reliability. The latch 300 includes a ratchet and pawl 314 and 315 which may be similar to the ratchet 14 and pawl 15 (FIG. 1B), and which may be biased by a ratchet biasing member and a pawl biasing member respectively, which may be similar to the ratchet and pawl biasing members in FIGS. 1-4). The ratchet biasing member is obscured from view in FIGS. 5A and 5B, however, the pawl biasing member is shown at 322 in FIG. 5B.

A pawl release lever is shown at 317 and may be similar to pawl release lever 17 (FIG. 1B). The pawl release lever 317 is pivotable between a home position and a pawl release position (FIG. 9) by any one of several elements, including an inside door release lever 301 via a lock link 302, a power release actuator 318 and an outside door release lever 502 (FIG. 5B). Pivoting of the pawl release lever 317 from a rest position (FIG. 6) to a pawl release position (FIG. 9) causes pawl release arm 382 on lever 317 to engage lever receiving arm 383 on the pawl 315 and to drive the pawl 315 to the ratchet release position. In the views shown in FIGS. 6-10 the pawl release lever 317 pivots counterclockwise to reach the pawl release position. The pawl release lever 317 may be biased towards the home position by a pawl release lever biasing member 381.

In similar manner to the power release actuator 18 in FIG. 1B, the power release actuator 318 (FIGS. 5A and 5B) includes a power release actuator motor 336 with an output shaft with a worm 340 thereon. The worm 340 rotates a worm gear 342 (which may be referred to as a driven gear) which has a pawl drive surface 385 (FIG. 5B) thereon that is engageable with the lever receiving arm 383 on the pawl 315. The worm gear 342 is rotatable by the motor 336 (via the worm 340) between a home position (FIG. 6) and a pawl release position in which the worm gear 342 drives the pawl 315 to the ratchet release position. An ECU 320 controls the operation of the motor 336. The worm gear 342 may be biased towards the rest position by a worm gear biasing member 387 (FIG. 5B). It will be noted that during this movement, the worm gear 342 backdrives the worm 340. To permit this, the worm 340 has a thread angle that makes the worm 340 backdrivable.

Figure 6:
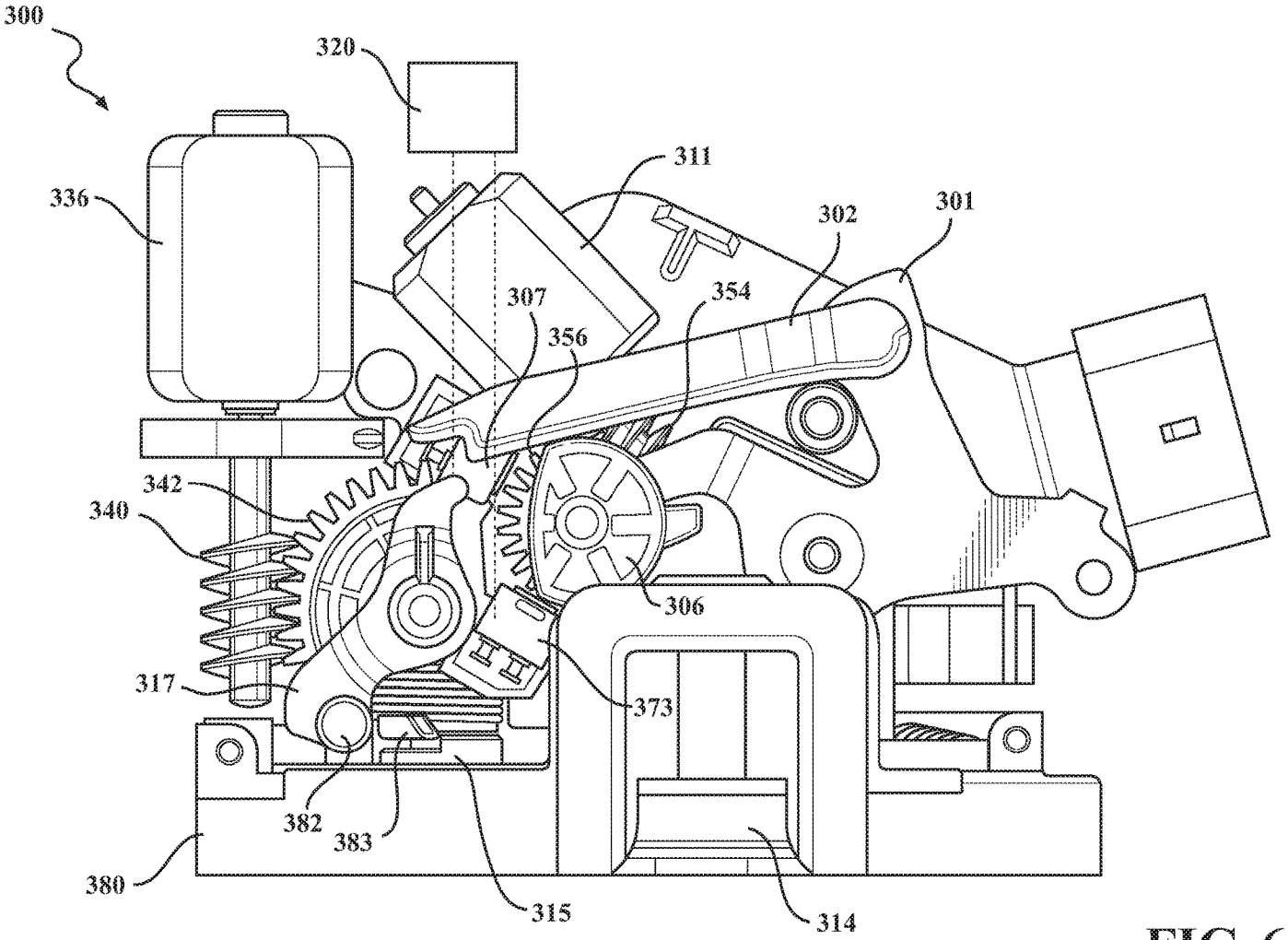
FIG. 6 is an elevation view showing the power latch assembly shown in FIG. 5A in a locked state.
Figure 7:
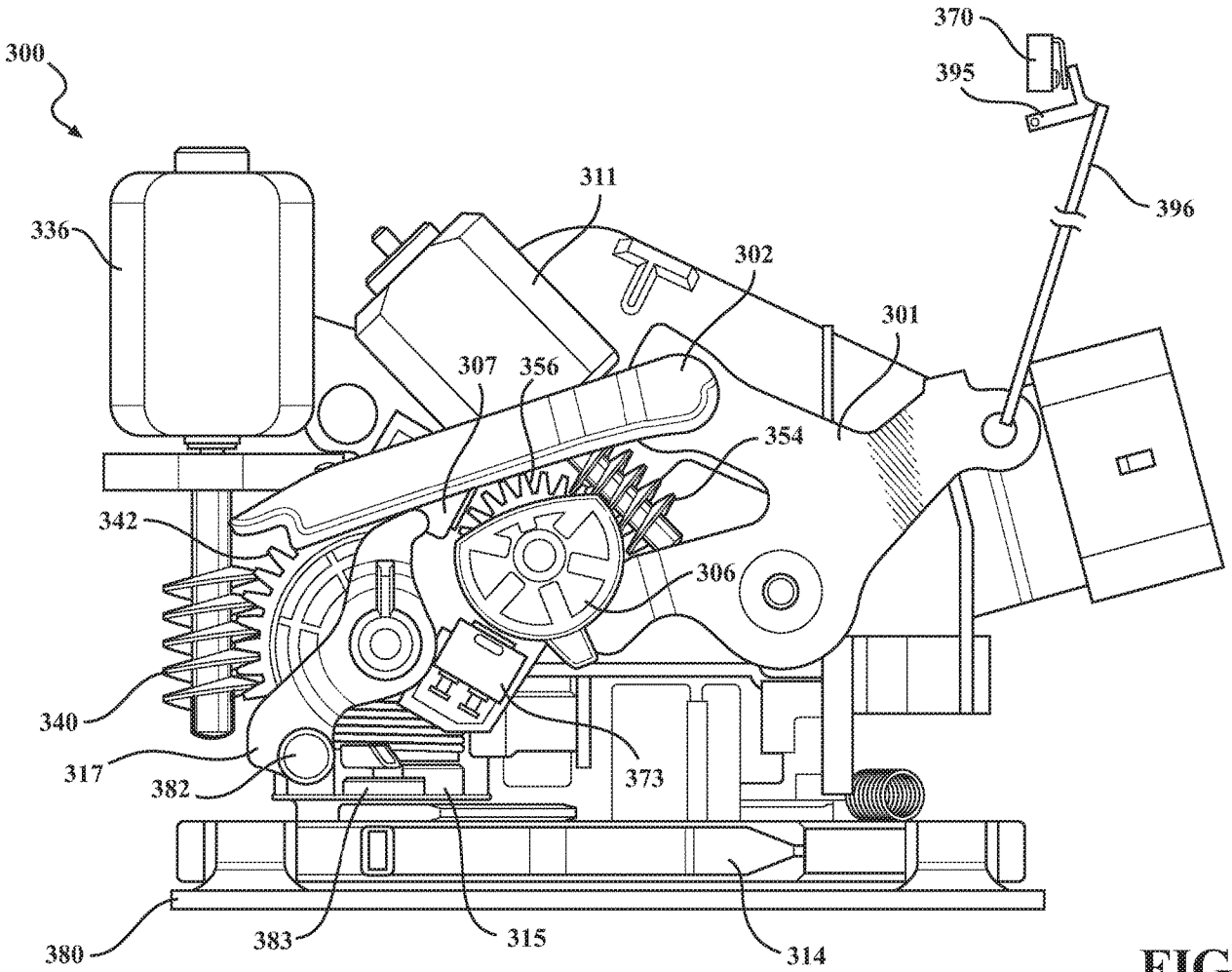
FIG. 7 is an elevation view showing the power latch assembly shown in FIG. 5A in a locked state, wherein an insider door handle has been actuated.

The inside door release lever 301 is movable (e.g. by a counterclockwise pivoting movement in the view shown in FIG. 6) from a home position (FIG. 6) to an actuated position (FIG. 7), and is biased towards the home position by an inside door release lever biasing member 346. The inside door release lever 301 is actuated by an inside door handle 395 (e.g. via a cable 396) as shown in FIGS. 6 and 7. The inside door handle 395 is movable (e.g. pivotable) between a home position (FIG. 6) and an actuated position (FIG. 9) wherein the door handle 395 brings the inside door release lever 301 to the actuated position. The door handle 395 may be biased towards the home position by an inside door handle biasing member 397 (e.g. a torsion spring).

The inside door handle 395 has an inside door handle state switch 370 associated therewith. The state switch 370 may have a first state, (e.g. off) when the inside door handle, and therefore the inside door release lever 301, is in the home position. The state switch 370 may have a second state, (e.g. on) when the inside door handle 395, and therefore the inside door release lever 395, is in the actuated position. Thus the state of the state switch 370 is indicative of the position of both the inside door handle 395 and of the inside door release lever 301. As such, the inside door handle state switch 370 may also be referred to as an inside door release lever state switch 370. In an alternative embodiment, the state switch 370 may be positioned so as to be engaged by the door release lever 301 instead of being engaged by the inside door handle 395.

An outside door handle 322 is provided and is movable (e.g. by a counterclockwise pivoting movement) from a home position (FIG. 6) to an actuated position, and is biased towards the home position by an outside door handle biasing member 323 (e.g. a torsion spring). The outside door handle 322 has an outside door handle state switch 324 associated therewith. The state switch 324 may have a first state, (e.g. off), when the outside door handle 322 is in the home position, and a second state, (e.g. on), when the outside door handle 322 is in the actuated position. Thus the state of the state switch 324 is indicative of the position of the outside door handle 322.

The ECU 320 (FIG. 5A) includes a processor 320*a* and a memory 320*b* that stores data used by the processor 320*a* during operation of the latch 300. The ECU 320 may be programmed in any suitable way to carry out operation of the latch 300 as described herein. The ECU 320 receives signals from the outside door handle state switch 324 and from the inside door handle state switch 370 and uses these signals to control the operation of the power release actuator motor 336, depending on what mode the ECU 320 is in. The ECU 320 is operable to be in a locked state (which may be referred to as a 'single-locked' state, or a first locked state, an unlocked state, and a second locked state. In the unlocked state, the ECU 320 causes actuation of the power release actuator motor 336 upon receipt of an indication that either of the inside or outside door handles 395 or 322 has been actuated.

In the locked state, the ECU 320 ignores signals from both the inside and outside door handle state switches 370 and 324 and as a result actuation of the inside or outside door handles 395 or 322 does not result in opening of the vehicle door 900 (FIG. 11). In some embodiments, actuation of the inside door handle 395 a first time may signal the ECU 320 to change states from a locked state to an unlocked state. Alternatively, actuation of the inside door handle 395 a first time may signal the ECU 320 to change states from a locked state to an inside door handle unlocked state, wherein the ECU 320 continues to ignore signals from the outside door handle 322 but would actuate the power release actuator motor 336 upon a second actuation of the inside door handle 395. In yet another alternative, actuation of the inside door handle 395 may not cause the ECU 320 to leave the locked state and thus the ECU 320 when in the locked mode may continue to ignore signals indicative of actuation of both the inside and outside door handles 395 and 322.

The second locked state may correspond for example, to a double locked state in embodiments wherein the latch 300 is installed in a front door of a vehicle, or for example, to a child locked state in embodiments wherein the latch 300 is installed in a rear door of a vehicle.

If the ECU 320 is in a double locked state, the ECU 320 ignores signals from the state switches 370 and 324 that are indicative of the actuation of the inside and outside door handles 395 and 322 and may continue to do so until the ECU 320 changes to a different state. If the ECU 320 is in a child locked state, an initial actuation of the inside and outside door handles 395 and 322 does not result in the actuation of the power release actuator motor 336. However, ECU 320 may be programmed such that, upon receipt of an initial actuation of the inside door handle 395, the ECU 320 may change to an outside unlocked state whereby actuation of the inside door handle 395 would not result in actuation of the motor 336, but actuation of the outside door handle 322 would result in the actuation of the motor 336 thereby opening the latch 300 and the vehicle door.

Figure 8:
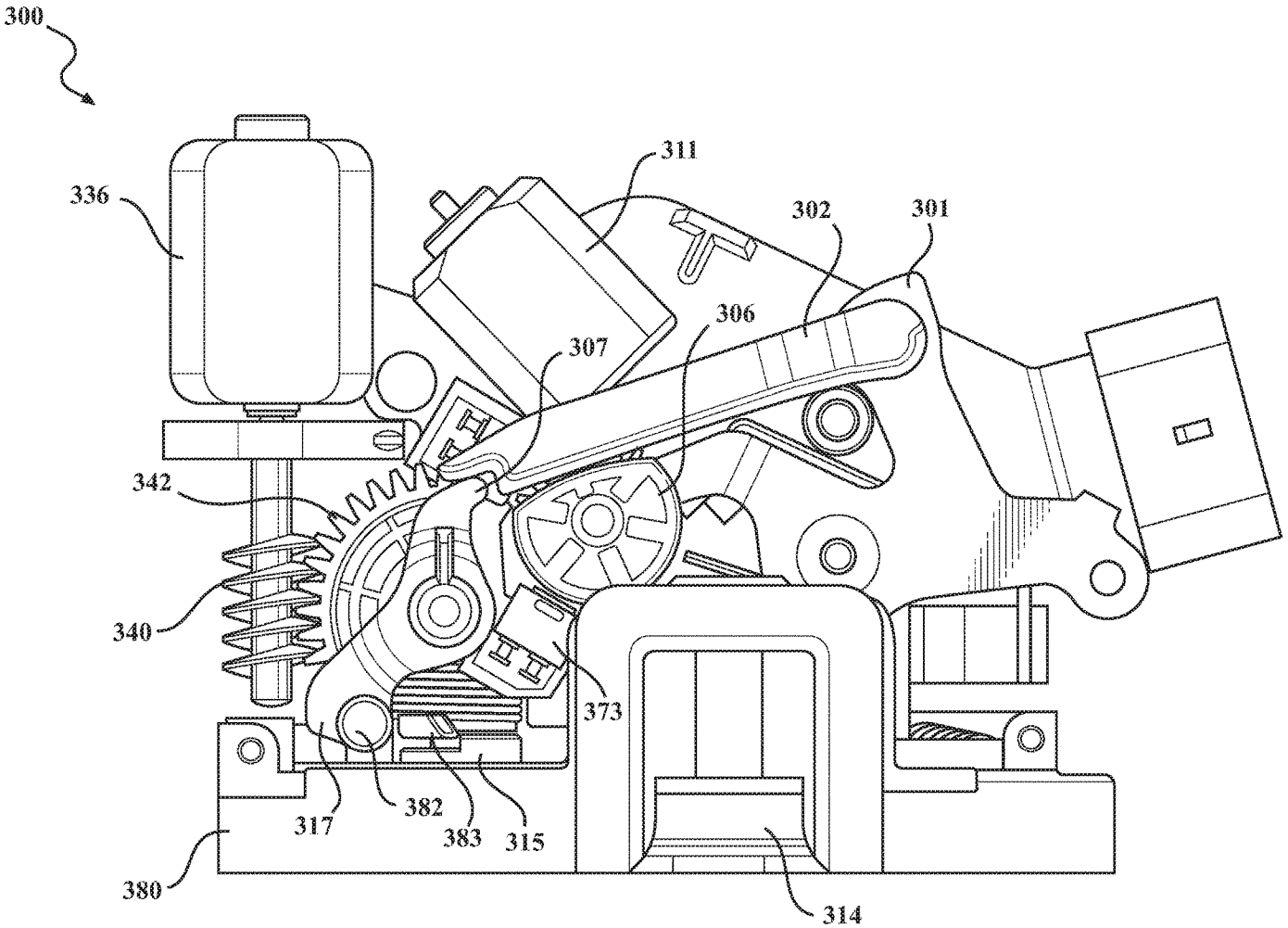
FIG. 8 is an elevation view showing the power latch assembly in FIG. 5A in an unlocked state.

A lock 327 is provided and is operable to prevent or permit mechanical actuation of the pawl release lever 317. The lock 327 includes, among other things, the lock link 302, a first cam 306 and a lock actuator 319. The lock link 302 is movable between an unlocked position as shown in FIG. 8 and a locked position shown in FIG. 6. In the unlocked position the lock link 302 operatively connects the inside door release lever 301 to the pawl 315 (via the common the release lever 317). In the locked position the lock link 302 operatively disconnects the inside door release lever 301 from the pawl 315. The movement of the lock link 302 may be a pivoting movement about a pivot axis 386 about which the lock link 302 may be pivotally connected to the inside door release lever 301. The lock link 302 is biased towards the unlocked position by a lock link biasing member which may be the tip (shown at 389 in FIG. 5B) of the inside door release lever biasing member 346, which may be any suitable type of biasing member such as a torsion spring.

Figure 9:
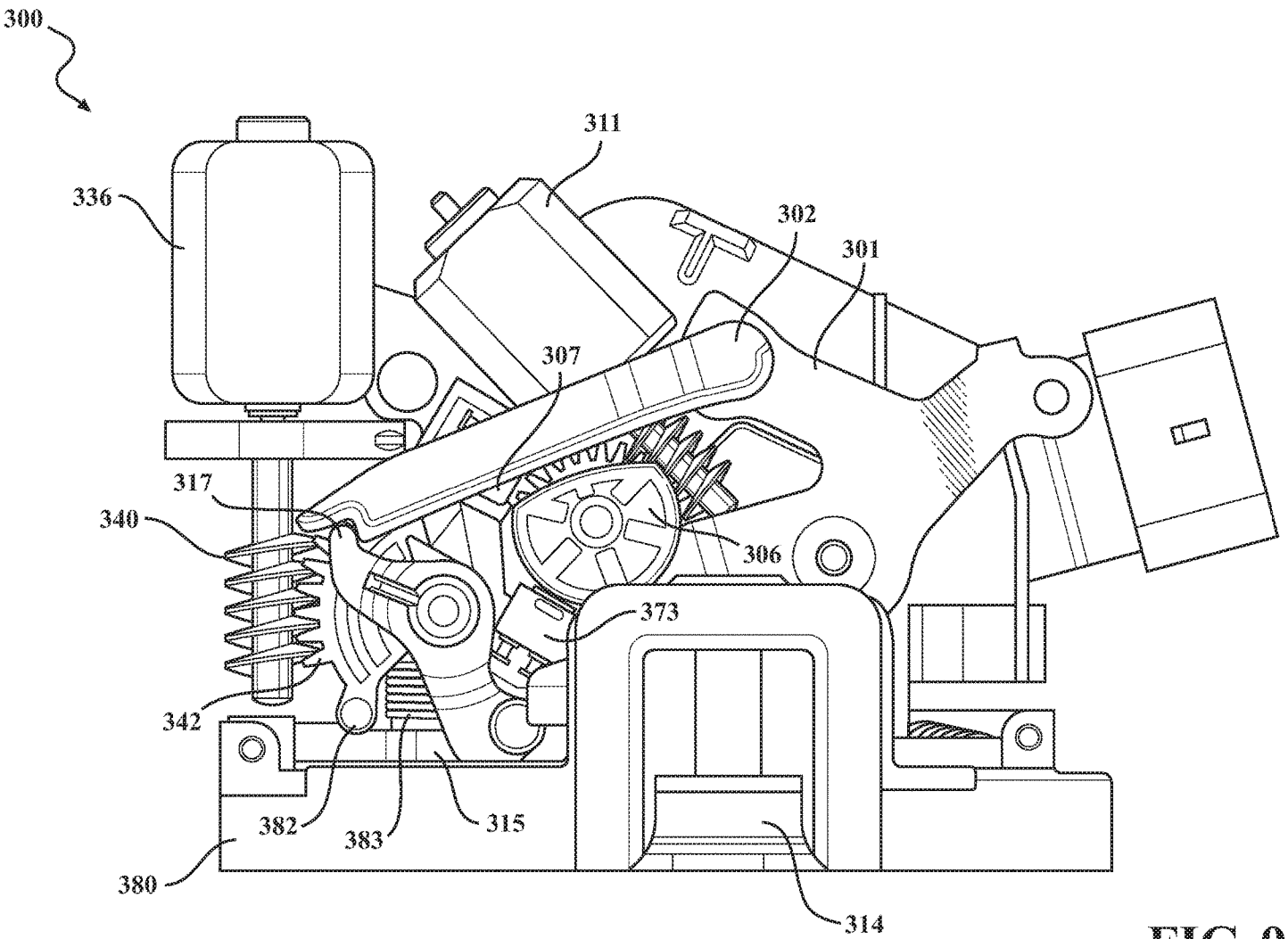
FIG. 9 is an elevation view showing the power latch assembly shown in FIG. 5A in an actuated state so as to permit opening of a vehicle door containing the latch.

The inside door release lever 301 pivots (counterclockwise in the views shown in FIGS. 6-10) from a home position (shown in FIG. 6) to an actuated position, thereby driving the lock link 302 to the left in the views shown in FIGS. 6-10. If the lock link 302 is in the unlocked position (FIG. 8), actuation of the release lever 301 drives the lock link 302 into a lock link receiving surface 388 on the pawl release lever 317 thereby driving the pawl release lever 317 to the pawl release position (FIG. 9). If the lock link 302 is in the locked position (FIG. 6), actuation of the release lever 301 drives the lock link 302 to the left in the view shown in FIGS. 6-10, but above the pawl release lever 317 (FIG. 7) such that the lock link 302 does not drive the common release 317 to the pawl release position.

Figure 10:
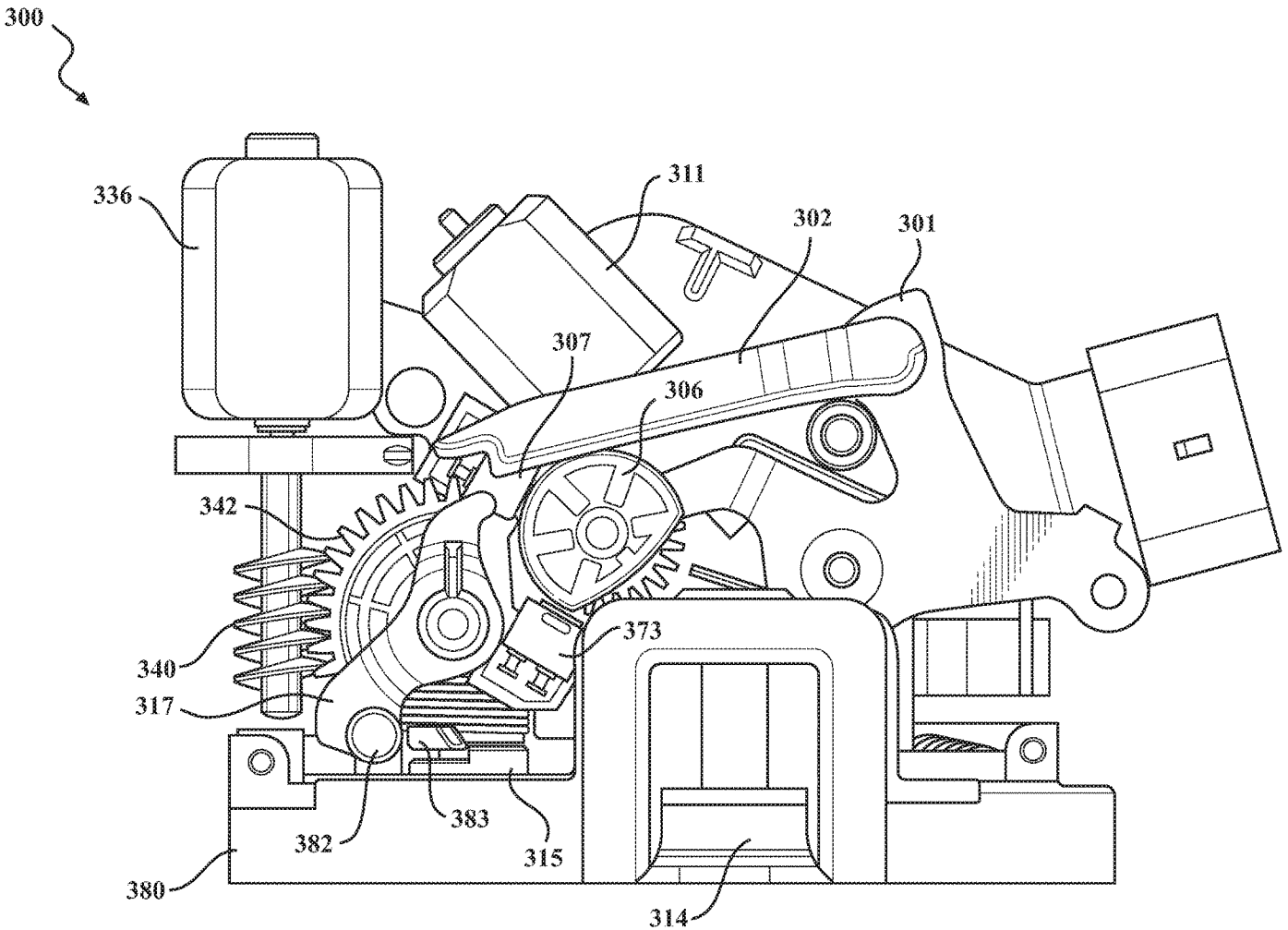
FIG. 10 is an elevation view showing the power latch assembly shown in FIG. 5A in a second locked state.

The first cam 306 is provided to control the position of the lock link 302 between the locked and unlocked positions, and may thus be referred to as a lock link control cam 306. The lock link control cam 306 is positionable in a locking position as shown in FIG. 6, an unlocking position as shown in FIG. 8 and a second locking position as shown in FIG. 10. In the unlocking position as shown in FIG. 8, the first cam 306 permits the lock link 302 to drive the pawl release lever 317 to the pawl release position as a result of actuation of the inside door release lever 306, thereby opening the latch 300 and the vehicle door. When the cam 306 is in the unlocking position the lock 327 is in an unlocked state.

When the first cam 306 is in the locking position the first cam 306 moves the lock link 302 to the locked position and thereby prevents the lock link 302 from driving the pawl release lever 317 to the pawl release position. However, when the first cam 306 is in the locking position, a cam drive surface 398 on the inside door release lever 301 is engageable with an override member 310 that is connected to the first cam 306 thereby operatively connecting the inside door release lever 301 with the first cam 306. The override member 310 may be said to be in an actuatable position. As a result, movement of the inside door release lever 301 to the actuated position (FIG. 7) drives the first cam 306 to the unlocking position. While the release lever 301 remains actuated, the lock link 302 extends above the pawl release lever 317 and is prevented by the pawl release lever 317 itself from moving to the unlocked position under the urging of the lock link biasing member 386. Once the inside door release lever 301 is returned to the home position (FIG. 8) the lock link 302 retracts sufficiently that the pawl release lever 317 no longer obstructs movement of the lock link 302, and thus the lock link biasing member 386 moves the lock link 302 to the unlocked position. Thus, as a result of a first or initial actuation of the inside door release lever 301 the lock 327 is in the unlocked state. As a result, a second actuation of the inside door release lever 301 opens the latch 300 and the vehicle door.

The second locking position, shown in FIG. 10, may, for example, be a double locking position or a child locking position. When the first cam 306 is in the second locking position, the override member 310 is in a non-actuatable position and so the cam drive surface 398 on the inside door release lever 301 cannot actuate the override member 310 and is thus operatively disconnected from the first cam 306. As a result, movement of the inside door release lever 301 to the actuated position produces no effect on the first cam 306.

Figure 5C:
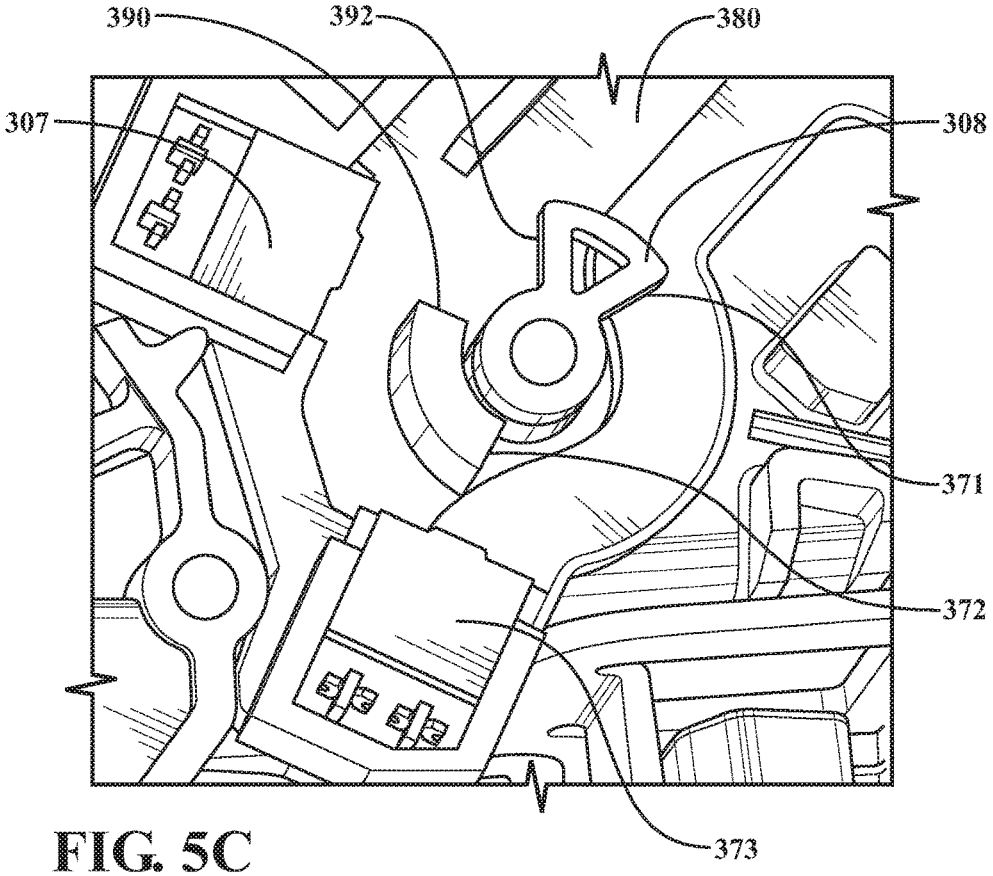
FIG. 5C is a magnified perspective view of a portion of the power latch assembly of FIG. 5B.
Figure 5D:
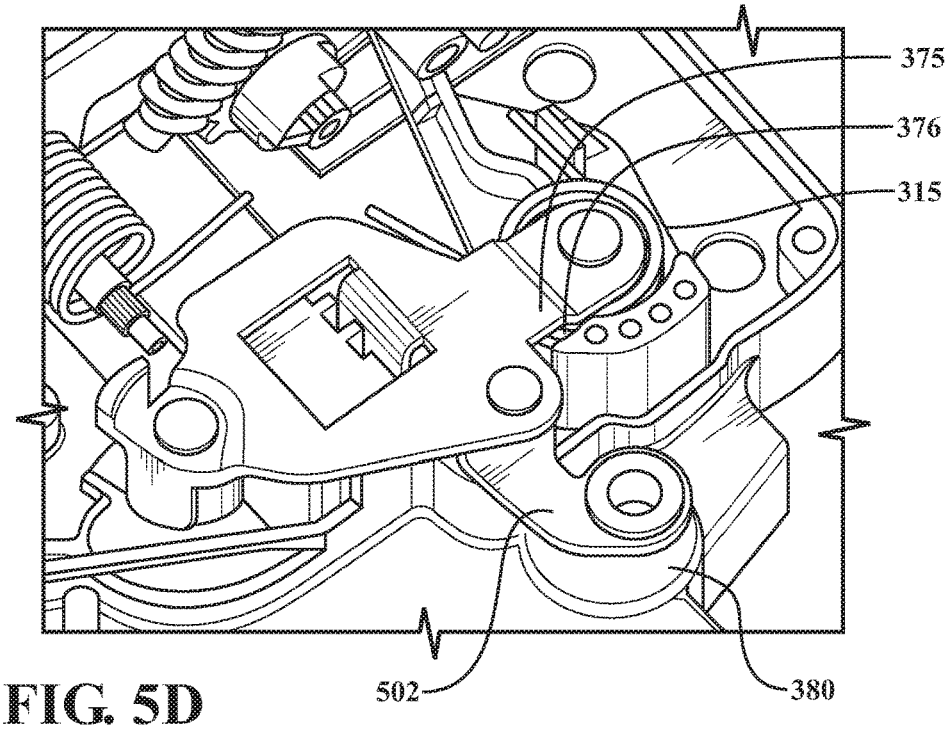
FIG. 5D is a magnified perspective view of a portion of the power latch assembly shown in FIG. 5B.

The lock actuator 319 includes a lock motor 311 that drives a worm 354, that, in turn, drives a worm gear 356 (which may be referred to as a driven gear). The worm gear 356, in turn, is connected to and thus drives the first cam 306. To reach the locking position, the lock motor 311 may drive the rotation of the first cam 306 in a first direction (counterclockwise in the view shown in FIG. 6) until the lock motor 311 stalls as a result of engagement of a first limit surface 390 (FIG. 5B) on the first cam 306 with a first limit surface 392 (FIG. 5C) on the housing (shown at 380) of the latch 300.

As noted above, movement of the inside door release lever 301 to the actuated position (FIG. 7) drives the first cam 306 to the unlocking position when the first cam 306 is in the locking position. It will be noted that during this movement, the worm gear 356 backdrives the worm 354. To permit this, the worm 354 has a thread angle that makes the worm 354 backdrivable.

When the first cam 306 is in the locking position shown in FIG. 6, a first switch 307 which may be a first locking position state switch 307 is closed by engagement with a state switch cam 308 that co-rotates with the first cam 306. The ECU 320 receives signals from the first locking position state switch 307 indicative of the state of the switch 307. The closing of the first locking position state switch 307 by the state switch cam 308 indicates to the ECU 320 that the latch 300 is in a locked state, and as a result, the ECU 320 enters the locked state as described above.

As can be seen in FIG. 8, when the first cam 306 is in the unlocking position the position of the state switch cam 308 is away from the state switch 307, and as a result, the switch 307 is off (i.e. open). Thus, the ECU 320 determines that the first cam 306 is in the unlocked position, and as noted above, can enter an inside unlocking state, an unlocked state or the ECU 320 can remain in the locked state.

To reach the second locking position, reversal of the current to the lock motor 311 may drive the first cam 306 in a second direction (clockwise in the view shown in FIG. 6) until the lock motor 311 stalls as a result of engagement of a second limit surface 371 (FIG. 5B) on the lock cam 308 and thus associated with the first cam 306, with a second limit surface 372 (FIG. 5C) on a portion of the housing 380 of the latch 300, as shown in FIG. 10. When the first cam 306 is in the second locking position shown in FIG. 10, the first locking position state switch 307 is open since the state switch cam 308 is unengaged with the switch 307. The latch 300 further includes a second switch 373, which may be a second locking position state switch, and which may be closed by engagement with the state switch cam 308 thereby indicating to the ECU 320 that the first cam 306 has reached the second locking position. As a result, the ECU 320 enters the second locked state as described above. Thus, during operation of the latch 300, the state switches 373 and 370 together have three states: a first state wherein the first state switch 370 is closed and the second state switch 373 is open, indicating that that the lock 327 is in the locked state, a second state wherein the first state switch 370 is open and the second state switch 373 is open, indicating that the lock 327 is in an unlocked state, and a third state wherein the first state switch 370 is open and the second state switch 373 is closed, indicating that the lock 327 is in a second locked state.

In each of the locked, unlocked, and second locked positions, the first cam 306 is held in each position by engagement between the worm 354 and the worm gear 356. There is no need for a biasing member to bias the first cam 306 towards any particular position.

It will be noted that, regardless of the state of the lock 327 the ECU 320 can be put into any of several unlocked states such that actuation of the inside and/or outside door handles 395 and 322 can be used to open the latch 300 and the vehicle door. Furthermore, actuation of the pawl release lever 317 by the power release actuator motor 336 takes place without requiring or generating any movement of the lock link 302 or other components of the lock 327. As a result, the latch 300 can include a passive entry feature such that detection by the ECU 320 of a key fob associated with the vehicle, can be used to unlock at least the outside door handle 322 of the latch 300 essentially instantaneously, since such unlocking amounts to a change of state of the ECU 320 from the locked state to the unlocked state (or to an outside door handle unlocked state). When the user actuates the outside door handle 322, the motor 336 is needed only to actuate the pawl release lever 317 and not any of the components of the lock 327 thereby reducing the work that needs carried out by the motor 336 to open the latch 300, which in turn reduces the amount of time that is needed to open the latch 300. This can result in less of a wait time by the user of the vehicle before the vehicle door opens after the outside door handle 322 has been actuated.

Referring to FIG. 5B, the outside door release lever 502 is a lever that can be used to mechanically actuate the pawl 315 from outside the vehicle in situations where such actuation is needed (e.g. in the event of a loss of power to the latch, or failure of the motor 336). The outside door release lever 502 may be pivoted (clockwise in FIGS. 6-10) by inserting a key into and turning the key cylinder (not shown), thereby driving the pawl 315 to the ratchet release position by engagement of a drive surface 375 on the release lever 502 with a receiving surface 376 on the pawl 315.

As can be seen the latch 300 operates without using a lock lever, which reduces the number of components in the latch 300 as compared to the latch 13 in FIGS. 1-4.

The outside door handles 22 and 322 have been shown in the figures as being pivotable members that engage limit switches shown at 24 and 324 respectively. It will be understood that the door handles 22 and 322 need not be movable at all, and the switches 24 and 324 could be configured to sense the presence of a user's hand on or near the door handle 22 or 322. For example, the switch could be a proximity sensor, or a suitable type of touch sensor (e.g. a resistive, capacitive or projected capacitive touch sensor).

The ECU 320 has been described as having a locked state, an unlocked state and a second locked state, which could be a child locked state or a double locked state. It will be noted that it is possible for the ECU 320 to be capable of having a child locked state and capable of having a double locked state. In other words the latch 300 may be configured to three different locked states that can be selected by the user, namely, a locked state wherein the inside and outside door handles 395 and 322 are disabled (but in which the first cam 306 is positioned to permit a mechanical override by the inside door handle 395), a child locked mode wherein the inside and outside door handles 395 and 322 are disabled (but in which a first actuation of the inside door handle 395 brings the ECU 320 to an outside door handle unlocked state wherein actuation of the outside door handle 322 causes the ECU 320 to actuate the power release actuator motor 336 to open the latch 300 and actuation of the inside door handle 395 does not cause actuation of the power release actuator motor 336), and a double locked state wherein the inside and outside door handles 395 and 322 are disabled and cannot be reenabled by actuation of either handle 395 or 322.

While two switches 307 and 373 are shown to assist the ECU 320 in determining whether the first cam 306 is in a locked state, an unlocked state, or a second locked state, it will be noted that it is possible to provide a structure wherein a single three position switch could be used to indicate to the ECU 320 which state the first cam 306 is in.

The above described closure latches, associated with FIGS. 1-10 are presented to illustrate examples of power latch assemblies having a power release feature and to which the following additional feature may be incorporated. In particular, the present disclosure is directed to incorporation of a key-type mechanical release mechanism configured to allow manual release of the locking mechanism from outside the vehicle in those situations where power release is not desired or is unavailable (i.e., no power provided to power release actuators). In particular, a key cylinder release mechanism for power latches is disclosed to permit a key inserted into a rotatable key cylinder to control deliberate and intentional movement of the pawl from its ratchet locking position into its ratchet released position, thereby allowing the ratchet to move from its closed position into its open position for permitting the door to be opened.

Referring initially to FIG. 11, various components of a power latch assembly 400 are disclosed, with other removed to better define the components associated with a key cylinder release mechanism 402 which embodies the inventive features of the present disclosure. That said, power latch assembly 400 is understood to include a ratchet and a pawl arrangement similar to those previously described. In general, key cylinder release mechanism 402 includes a key cylinder assembly 404 having a rotatable key cylinder 406, a key cylinder lever 408, a key cylinder rod 410, a release lever 412, and a release link 414. A key (not shown) may be inserted into key cylinder 406 for controlling bi-directional rotary movement of the key and key cylinder 406 between a first or "start of travel" position and a second or "end of travel" position. In FIG. 11, the key is removed from the key cylinder 406, and thus, the key cylinder 406 is locked in position to the release mechanism 402 cannot move under inertia load. Any relative movement between the key cylinder 406 and latch 400 will not cause release, because the release link 414 and a detent lever, also referred to pawl release lever 460, are on different planes. Lever 408 has a first segment 420 fixed for common rotation with key cylinder 406 and a second segment 422 having an aperture 424. Rod 410 is an elongated component having a first end segment 426 retained in lever aperture 424 and a second end segment 428 retained in an aperture 430 formed in a first leg segment 432 of release lever 412. Accordingly, the rod 410 operably couples the key cylinder 406 to the release link 414. Release lever 412 also includes a second leg segment 434 defining a pivot aperture 436 configured to support a pivot post (not shown). A release lever spring 438 extends between a latch plate 380' and second leg segment 434 of release lever 412 to normally bias release lever 412 toward a first or "non-actuated" position (shown in FIG. 11), thereby biasing the rod 410 and the key cylinder 406 to the start of travel position.

Link 414 is an elongated component having a first end segment 440, a second end segment 442, and an intermediate segment 444. First end segment 440 includes an upstanding post 446 which is retained in a lugged aperture 448 formed in release lever 412 at the junction of its first and second leg segments 432, 434. A spring member, also referred to as link spring 450, is disposed between intermediate segment 444 of release link 414 and latch housing 380'. The function of link spring 450 will be detailed with greater specificity hereinafter. A circumferentially continuous, circuitous guide slot 452 is formed in an edge surface, also referred to as side or side surface, of second end segment 442 of release link 414. A stationary guide pin 454, extending outwardly from a support shaft 456, is received and retained in guide slot 452. As will be detailed, the interaction between the contoured edge profile of guide slot 452 and guide pin 454 functions to control both sliding and pivotal movement of release link 414 upwardly and downwardly relative to latch plate 380'. Power latch assembly 400 is also shown to include the pawl release lever 460 pivotably mounted on a pivot post 462 extending from latch housing 380' and which is normally biased by a pawl release lever spring 464 toward a "home" position. Pawl release lever 460 is operable in its home position to maintain the pawl in its ratchet holding position. In contrast, movement of pawl release lever 460 to a "pawl release" position causes the pawl to move, directly or indirectly, to its ratchet release position, thereby releasing the ratchet for movement to its striker release position.

As shown in FIG. 11, the components of release mechanism 402 are located such that a "safe" mode is established when key cylinder 406 is locked in its start of travel position. As such, release lever 412 is located in its non-actuated position, and link 414 is located in a "lock" position disengaged from pawl release lever 460 such that pawl release lever 460 is biased by spring 464 into its home position.

Figure 12:
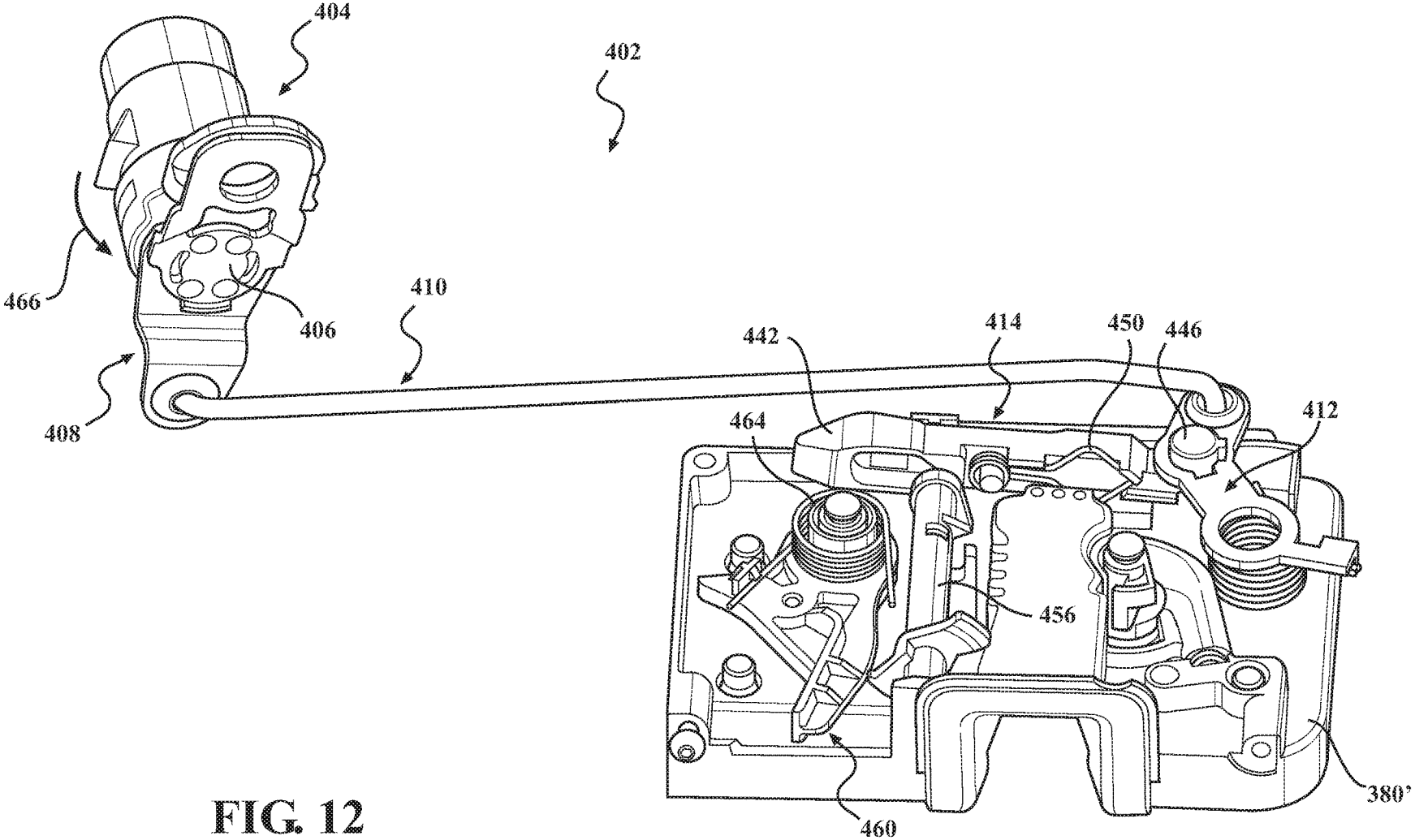
FIG. 12 is another isometric view of the key-type mechanical release mechanism illustrating initial actuation via rotation of a key in a first rotary direction from a "start of travel" position through a first range of motion.
Figure 13:
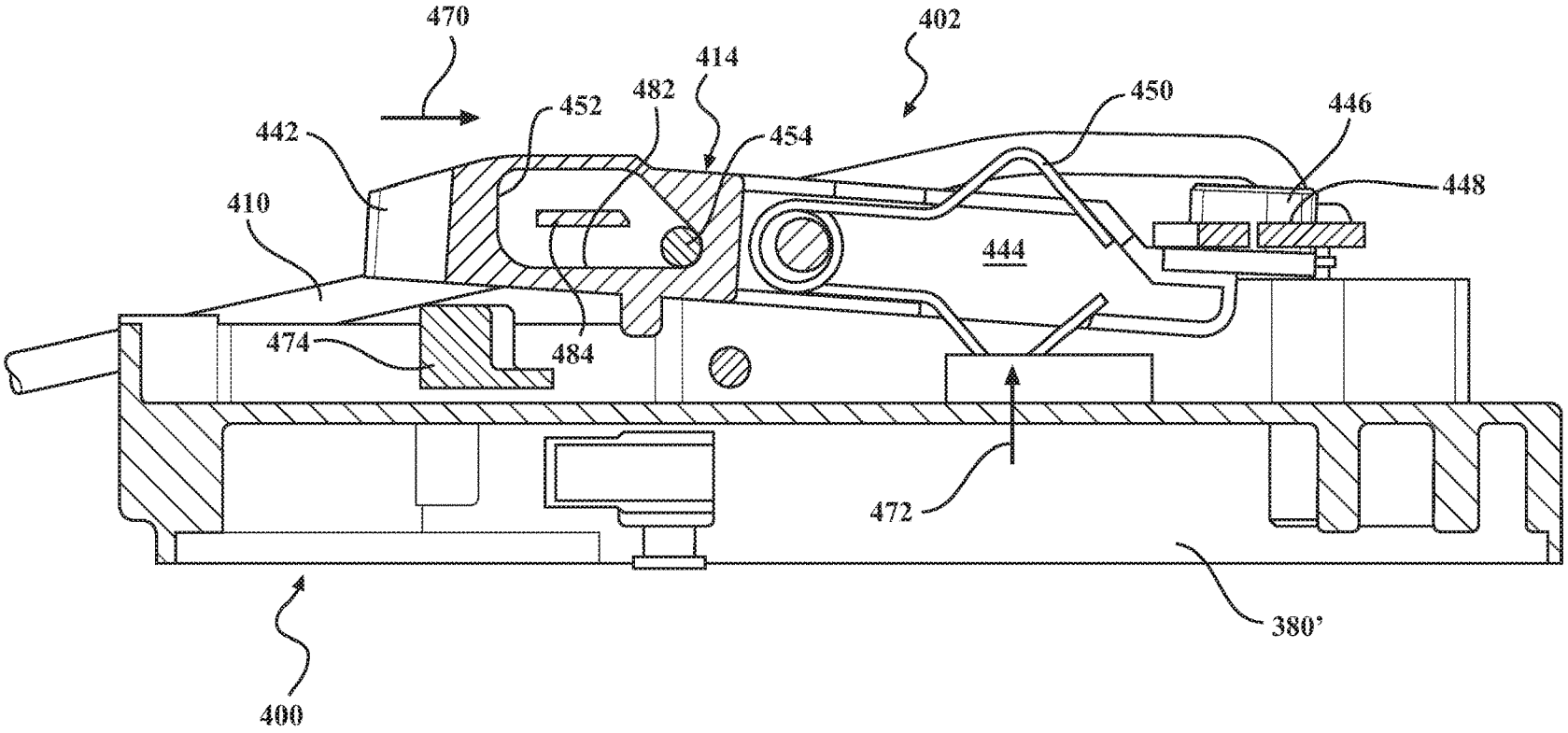
FIG. 13 is a side sectional view of the components shown in FIG. 12.

Referring now to FIGS. 12 and 13, a key has been introduced into key cylinder 406 and rotated in a first (CCW) rotary direction as indicated by arrow 466 which, in turn, causes common rotation of cylinder lever 408 in the first rotary direction through a first range of angular travel. This rotation of cylinder lever 408 causes rearward sliding movement of rod 410 in a first direction so as to initiate rotation of release lever 412, in opposition to the biasing of spring 438, from its non-actuated position in a first (CW) rotary direction about the pivot post (not shown). Due to post 446 of link 414 engaging release lever 412, such rotation of release lever 412 causes rearward sliding movement of release link 414 from its lock position, as indicated by arrow 470 in FIG. 13, generally along the first direction traversed by the rod 410. Note that guide pin 454 is positioned in a lower edge corner of a lower section 482 of guide slot 452 (FIG. 13) while arrow 472 indicates the upward biasing applied by link spring 450 to intermediate segment 444 of link 414. In this lock position of link 414, its second end segment 442 is located above and overlies a drive flange segment 474 of pawl release lever 460.

Figure 14:
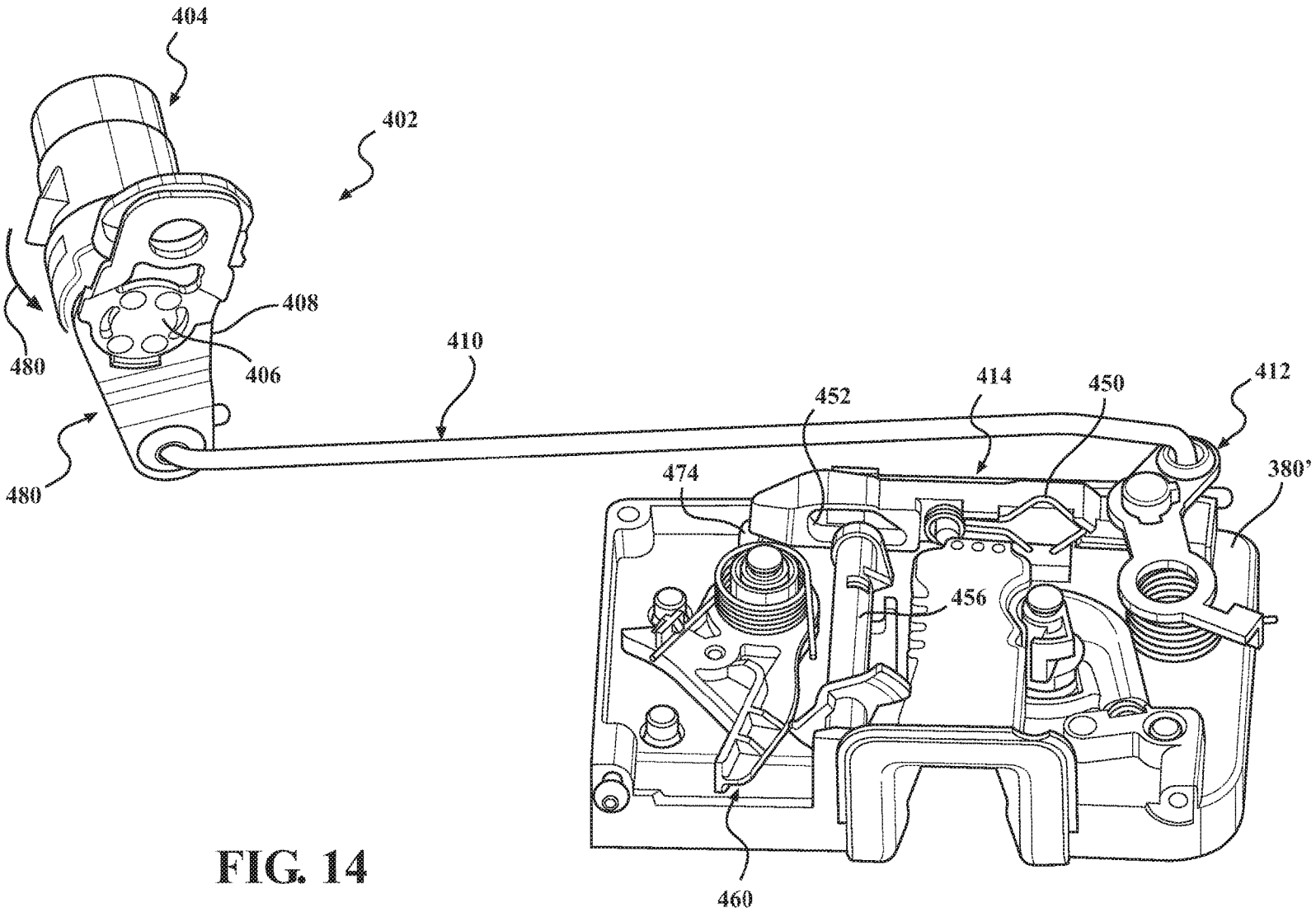
FIG. 14 is another isometric view of the key-type mechanical release mechanism illustrating continued actuation via rotation of the key in the first rotary direction through a second range of motion.
Figure 15:
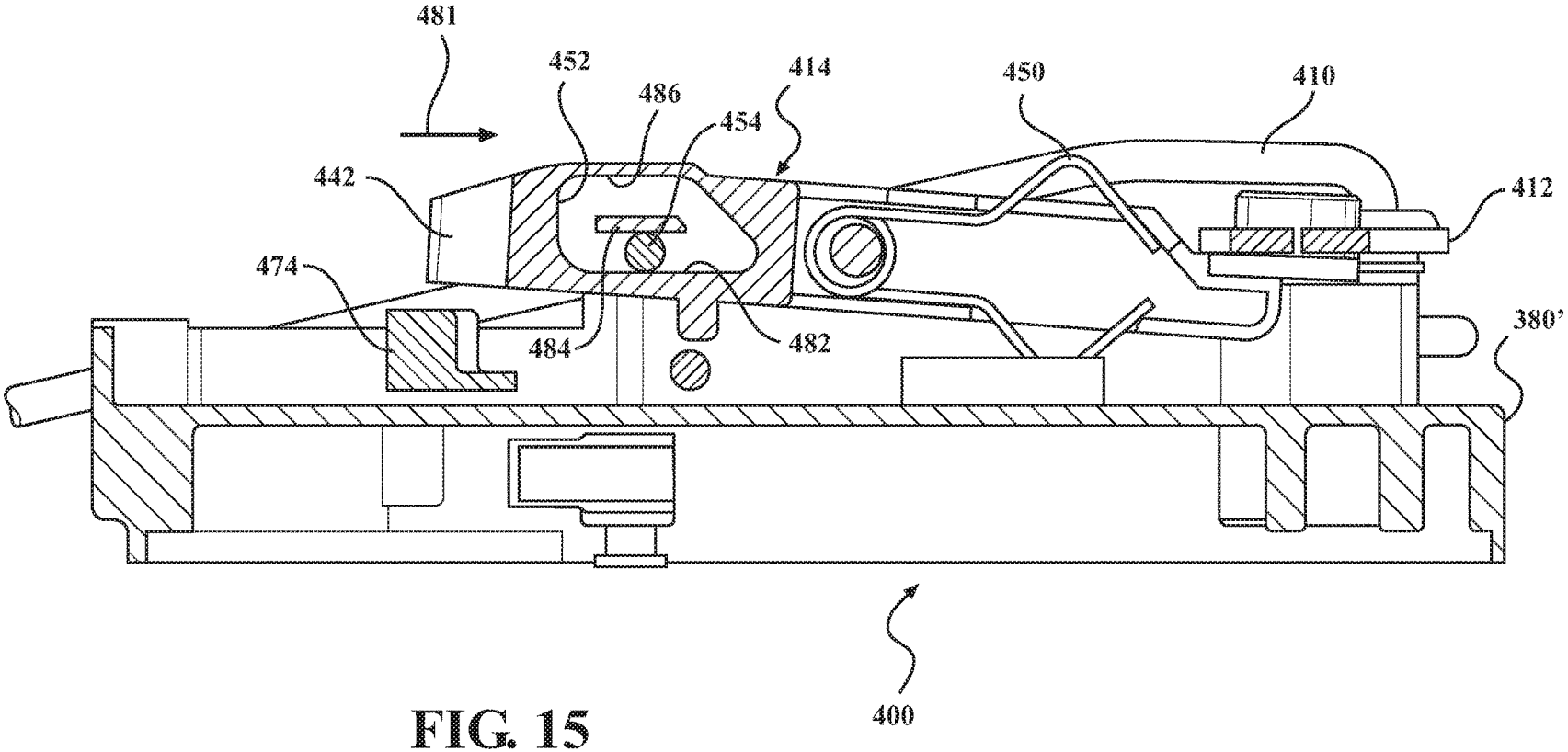
FIG. 15 is a side sectional view of the components shown in FIG. 14.

Referring now to FIGS. 14 and 15, the key has been rotated further in the first rotary direction, as indicated by arrow 480, which causes concurrent rotation of cylinder lever 408 through a second range of angular travel. This action results in continued rotation of release lever 412 from its non-actuated position toward an actuated position which, in turn, continues to slide link 414 in a rearward direction, as indicated by arrow 482. As seen from FIG. 15, second end segment 442 of link 414 is still located above and over drive flange 474 of pawl release lever 460. It is also noted, that the position of link 414 is dictated primarily by the location of guide pin 454 in lower guide segment 482 of guide slot 452 with link spring 450 no longer applying much, if any, biasing to link 414. A center web 484 formed in guide slot 432 delineates lower guide segment 482 from an upper guide segment 486 and defines a continuous circuitous guide channel therein.

Figure 16:
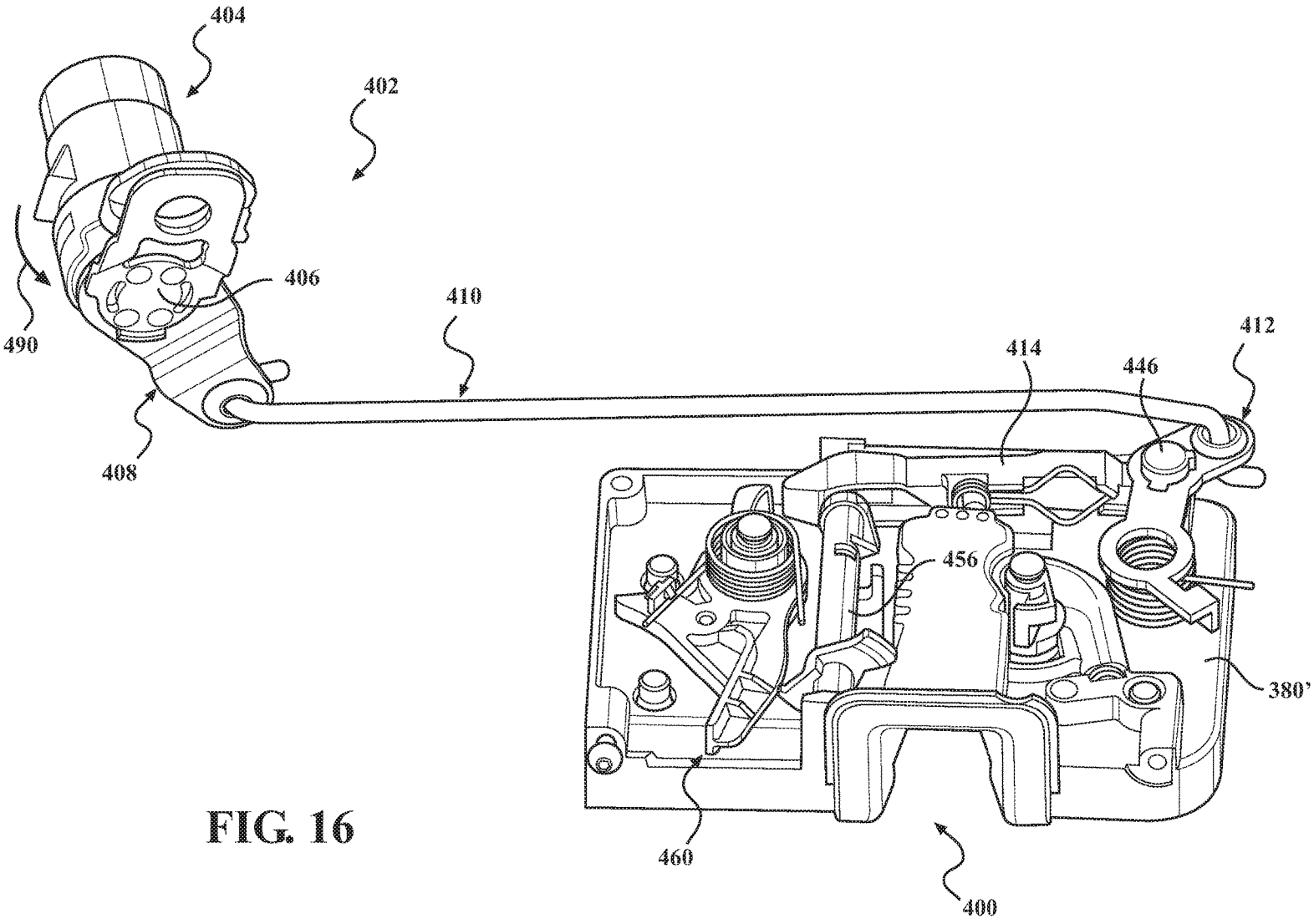
FIG. 16 is another isometric view of the key-type mechanical release mechanism illustrating continued rotation of the key in the first rotary direction through a third range of motion to an "end of travel" position.
Figure 17:
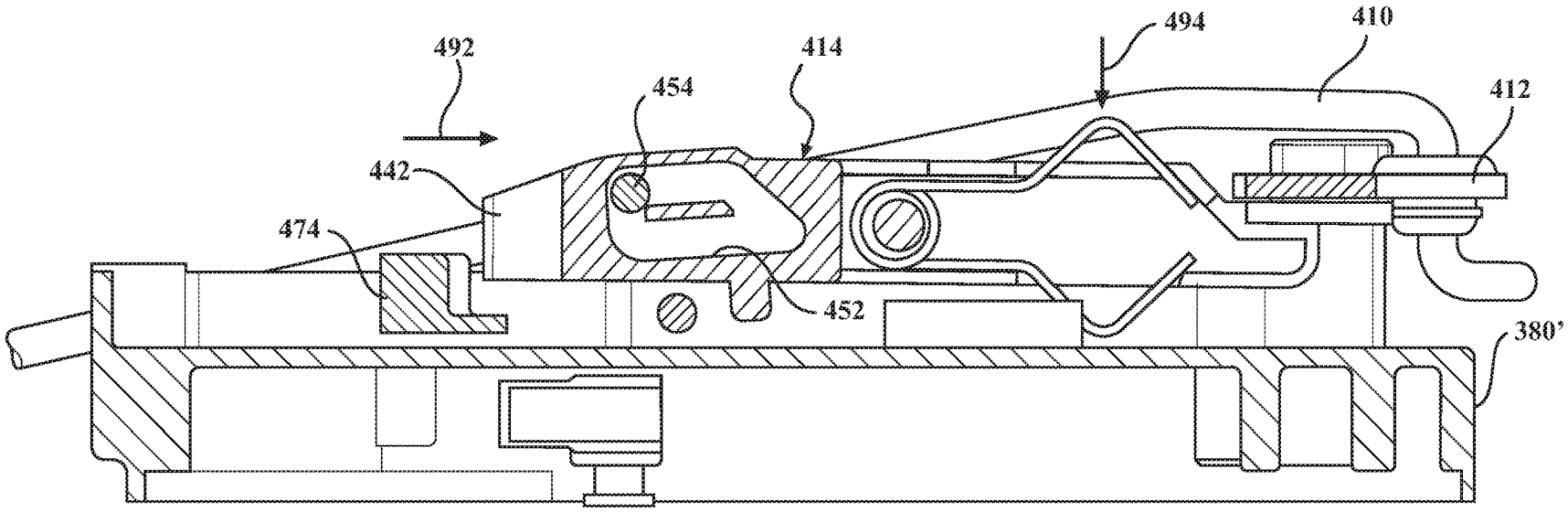
FIG. 17 is a side sectional view of the components shown in FIG. 16.

Referring now to FIGS. 16 and 17, the key has caused key cylinder 406 to be rotated still further in the first rotary direction, as indicated by arrow 490, to its "end of travel" position which causes cylinder lever 408 to force rod 410 to continue translating along the first direction to rotate release lever 412 into its "actuated" position. With release lever 412 located in its actuated position, link 414 has been rearwardly slid, as indicated by arrow 492, into its "unlock" position as best shown in FIG. 17. With link 414 located in its unlock position, spring 450 forcibly pivots link 414 downwardly, as indicated by arrow 494, such that guide pin 454 is now positioned in upper guide segment 486 of guide slot 452. As such, second end segment 442 is now aligned in a common plane with drive flange segment 474 of pawl release lever 460. This movement of key cylinder 406 from its start of travel position to its end of travel position defines a first input action on the part of the user.

Figure 18:
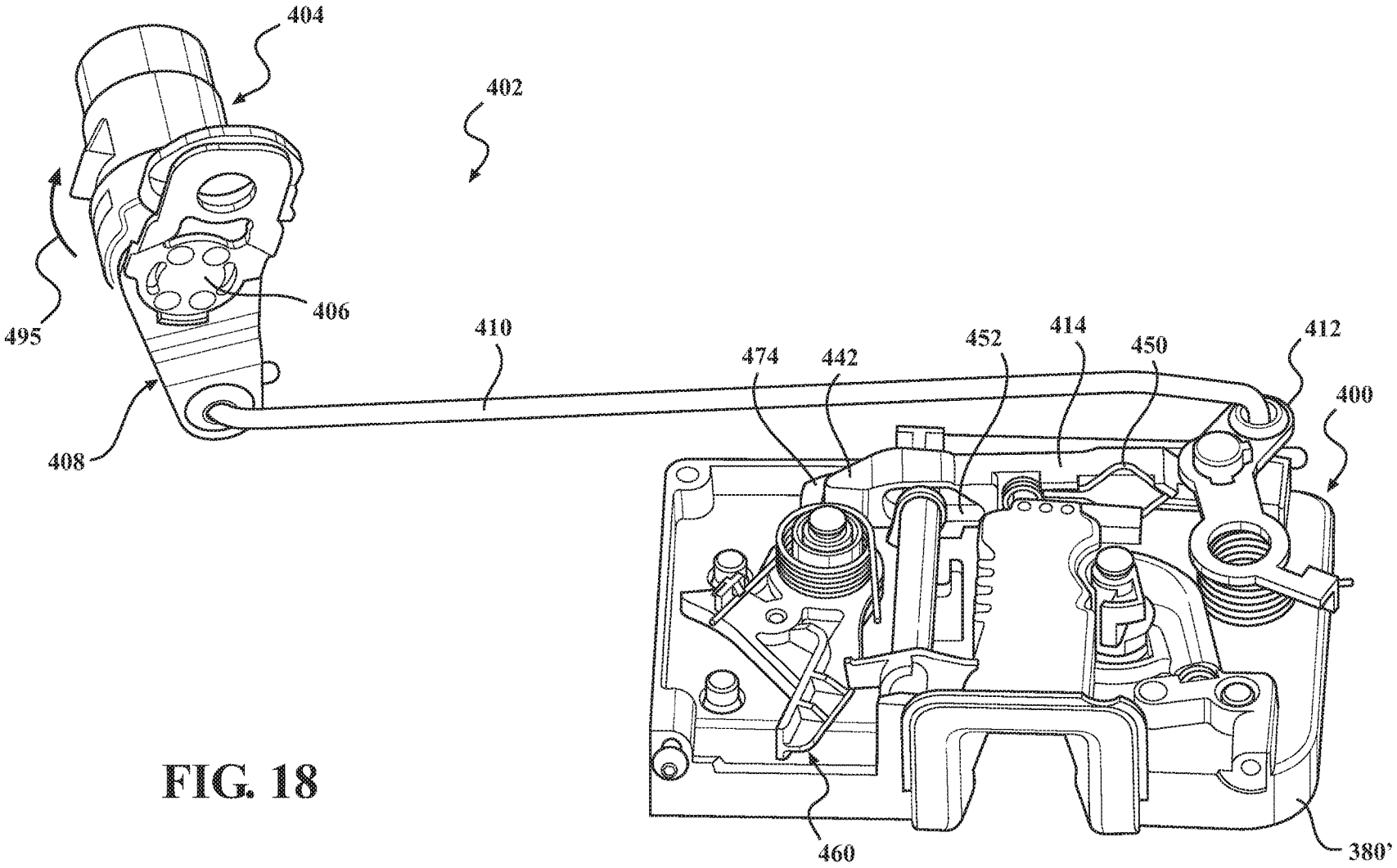
FIG. 18 is another isometric view of the key-type mechanical release mechanism illustrating continued rotation of the key in a second rotary direction opposite the first rotary direction from the end of travel position through a first range of motion.
Figure 19:
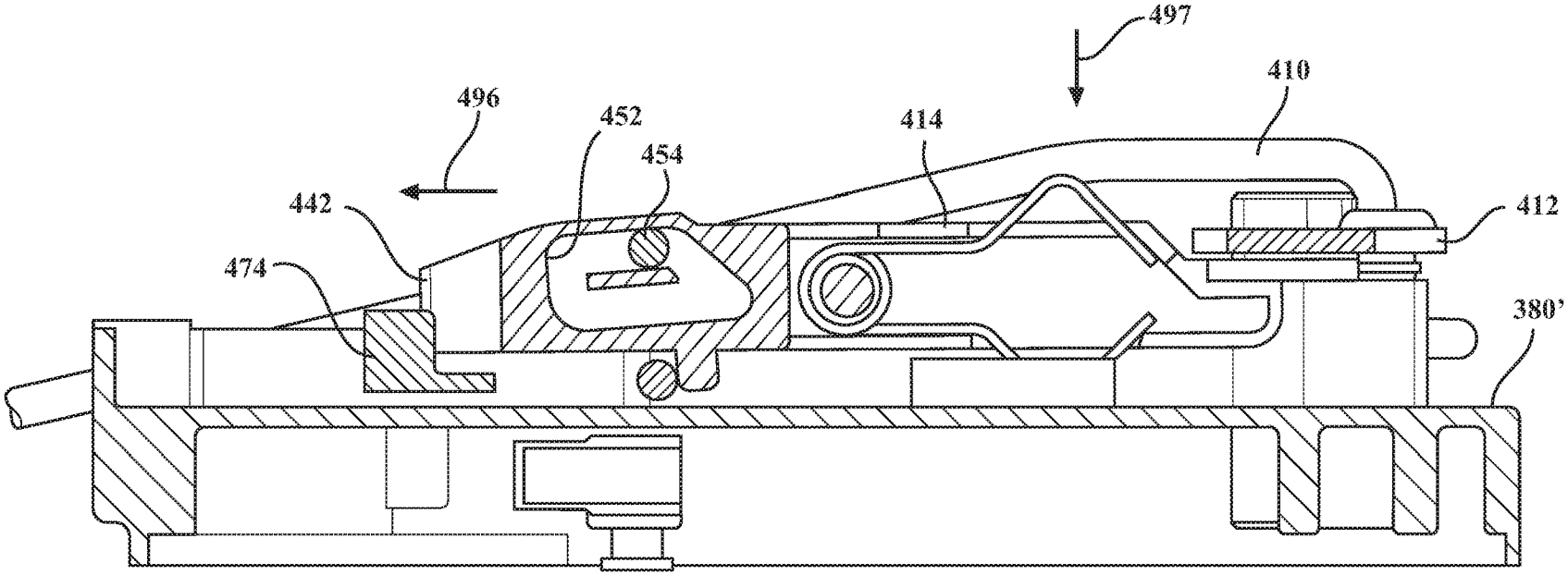
FIG. 19 is a side sectional view of the components shown in FIG. 18.

FIGS. 18 and 19 illustrate subsequent rotation of the key in a second rotary (CW) direction, as indicated by arrow 495, which causes concurrent rotation of key cylinder 406 and cylinder lever 408 through a first range of angular travel in this second direction. This action results in rod 410 moving slidingly or translationally in a second direction opposite the first direction, causing release lever 412 to rotate in a second rotary (CCW) direction from its actuated position. Note that spring 438 assists in moving release lever 412 in this second direction. Such rotation of release lever 412 cause forward sliding movement of link 414 generally along the second direction of traversing movement of the rod 410 and, due to guide pin 454 being located in upper guide segment 486, this results in second end segment 442 engaging drive flange 474 and forcibly moving pawl release lever 460 from its home position toward its pawl release position, in opposition to the biasing of spring 464. This sliding movement of link 414 to actuate pawl release lever 460 is indicated by arrow 496. Note that link spring 450 acts to bias link 414 in the downward direction, as indicated by arrow 497, thereby facilitating the guide pin 454 being located in the upper guide segment 486.

Figure 20:
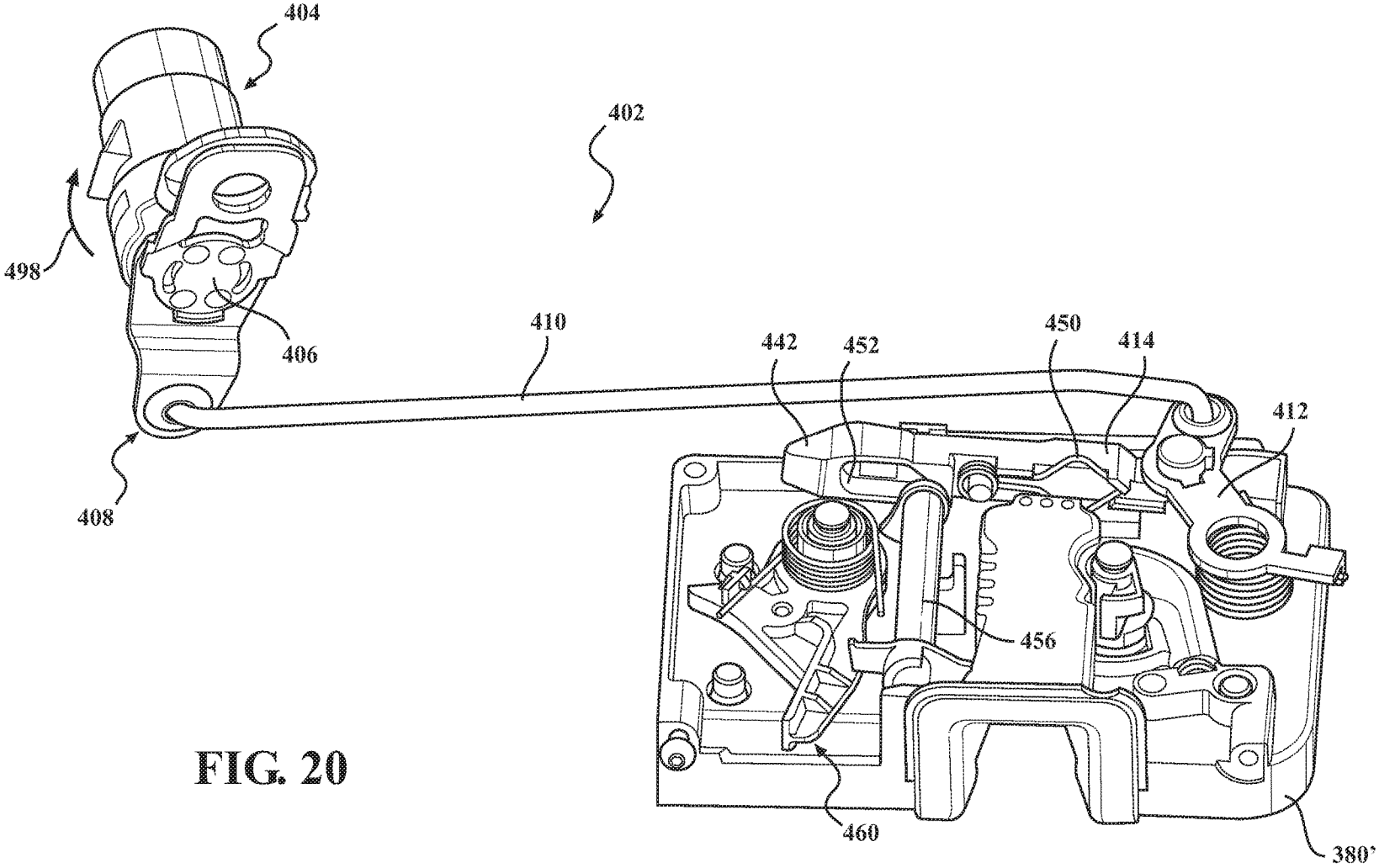
FIG. 20 is another isometric view of the key-type mechanical release mechanism illustrating continued rotation of the key in the second rotary direction through a second range of travel back to the start of travel position.
Figure 21:
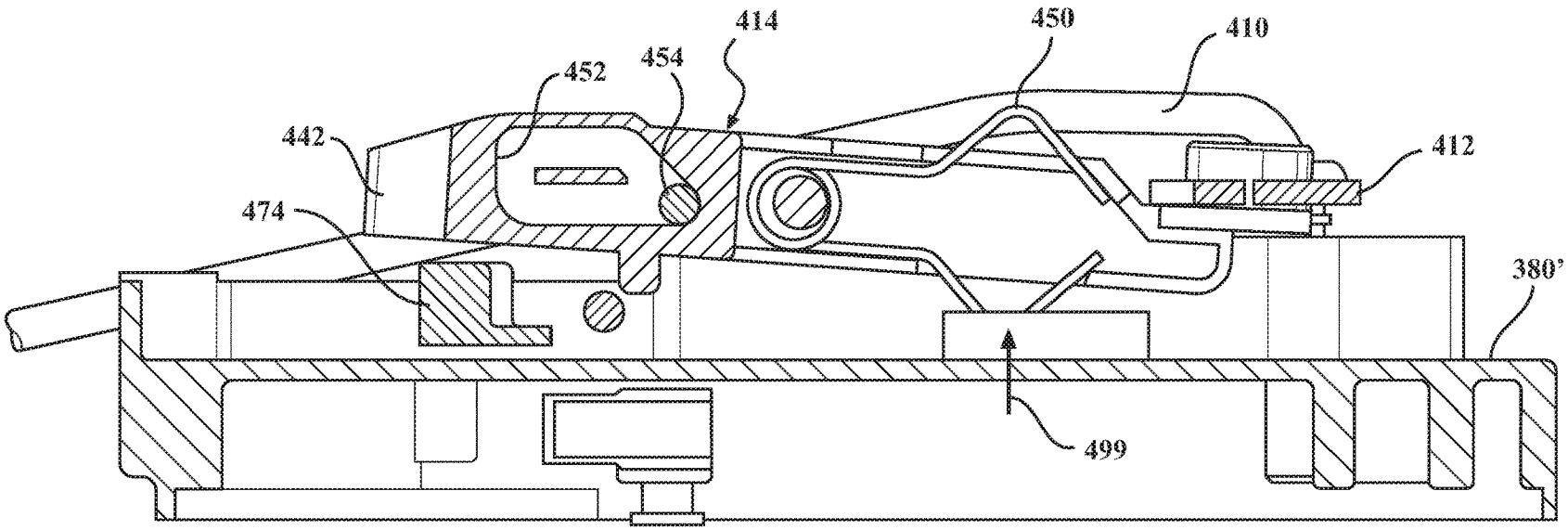
FIG. 21 is a side sectional view of the components shown in FIG. 20.

FIGS. 20 and 21 illustrate continued rotation of the key and key cylinder 406 in the second rotary direction through a second range of angular travel, as indicated by arrow 408, so as to locate cylinder 406 in its start of travel position. With key cylinder 406 returned to its start of travel position, mechanism 402 is operable to locate release lever 412 in its non-actuated position and locate release link 414 in its lock position. Specifically, the second range of motion results in guide pin 454 moving out of the upper guide slot segment 486 of guide slot 452. This action permits link spring 450, as indicated by arrow 499, to forcibly act to pivot link 414 upwardly so as to disengage second end segment 442 from drive flange 474 of pawl release lever 460. As seen, pawl release lever 460 subsequently returns to its home position due to the biasing of spring 464. The movement of key cylinder 406 from its end of travel position back to its start of travel position defines the second input from the user, recollecting that the first input was the initial rotation of cylinder 406 from its state of travel position to its end of travel position.

In accordance with the present disclosure, key cylinder release mechanism 402 requires a first input (i.e., rotation of cylinder 406 in the first rotary direction from its start of travel to its end of travel position) to initially shift link 414 into a position capable of mechanically releasing the latch mechanism, and a second input (i.e., rotation of cylinder 406) in the second rotary direction from its end of travel position into its start of travel position to mechanically release the latch assembly and subsequently reset the release mechanism. Thereafter, the key can be removed from key cylinder 406. Thus, release mechanism 402 disclosed herein requires two distinct activation inputs, such as the sequence of inputs in opposite directions, to mechanically release the latch assembly. Another feature that is realized by the nature of this design is that two separate activation inputs are required and it is impossible for the user to partially activate the release mechanism (i.e., once the key is inserted, it cannot be removed without being in the home position). This ensures that the device is always in the safe mode. In addition, this design is transparent to the user in that the user does not notice anything different than is normal with a key actuated release mechanism.

Figure 22:
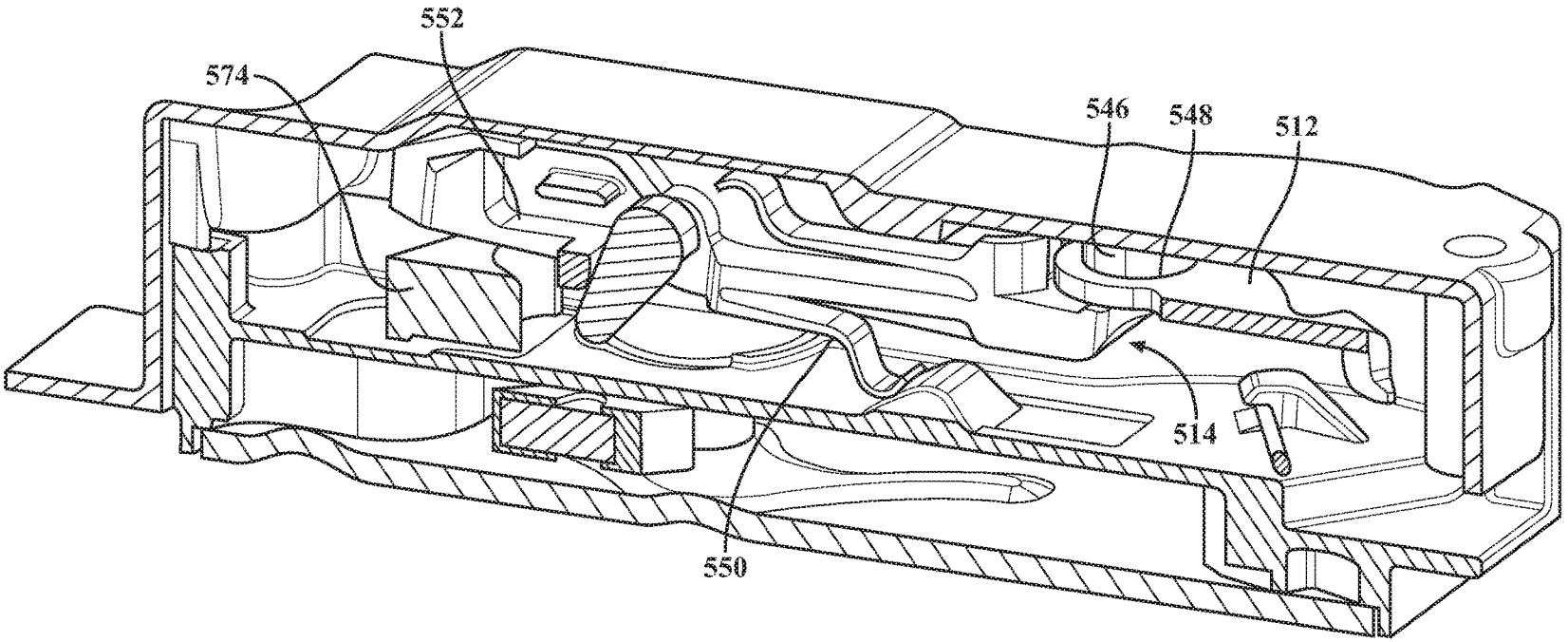
FIG. 22 is an isometric view of another key-type mechanical release mechanism adapted for integration with one or more of the power latch assemblies shown in FIGS. 1-10.

In FIG. 22, a portion of a key cylinder release mechanism constructed in accordance with another aspect of the invention is shown, wherein the same reference numerals as used above to describe the key cylinder release mechanism 402, offset by a factor of 100, are used to identify like features. It is to be recognized that the key cylinder release mechanism functions in the same way to achieve the same result as described above for the key cylinder release mechanism 402, and thus, aside from a brief review discussed below, repetition of the entirety of functional movements of the components of the mechanism in response to the insertion and rotation of the key within the mechanism is not described further below to avoid unnecessary repetition of that which would be readily understood by one skilled in the art.

The main difference between the key cylinder release mechanism 402 and the key cylinder release mechanism of FIG. 22 is with regard to the construction of their respective release links 414, 514. As discussed above and shown in the drawings, the release link 414 incorporates a separate spring member, referred to as link spring 450, to bias the release link 414 upwardly during the initial travel, as discussed with regard to FIGS. 12, 13 and subsequently at the end of travel, as discussed with regard to FIG. 21. Further, the link spring 450 functions to bias the release link 414 downwardly during different points of travel, such as discussed with regard to FIGS. 16-19. Now, with regard to the release link mechanism 514, a link spring 550 is also provided, wherein the link spring 550 functions in the same way as described for the link spring 450; however, the link spring 550 is constructed as a single piece (monolithic) of material with the body of the release link 514, wherein the body includes a guide slot 552 for guiding a stationary guide pin, as discussed above, as well as an upstanding post 546 for coupled receipt in a lugged aperture 548 of a release lever 512. Accordingly, rather than having multiple components, the body of the release link 514 and link spring 550 are formed as a single component, thereby enhancing the manufacturability and assembly of the components. It will be readily appreciated that the body of the release link 514 and link spring 550 can be molded of any suitable plastic material, or otherwise could be formed as a metal component, if desired, though plastic is believed to provide a more economical approach. Otherwise, aside from the link spring 550 being formed as a common, monolithic piece of material with the body of the release link 514, the cylinder release mechanism incorporating the release link 514 is essentially the same as that discussed above for the cylinder release mechanism 402, with a brief refresher description following as to the function of the key cylinder release mechanism 502.

The key cylinder release mechanism requires a first input (i.e., rotation of cylinder in the first rotary direction from its start of travel to its end of travel position) to initially shift release link 514 into a position capable of mechanically releasing the latch mechanism, and a second input (i.e., rotation of cylinder) in the second rotary direction from its end of travel position into its start of travel position to mechanically release the latch assembly and subsequently reset the release mechanism. Thereafter, the key can be removed from key cylinder. Thus, as discussed above, the release mechanism requires two distinct activation inputs, such as the sequence of inputs in opposite directions, to mechanically release the latch assembly. Given that two separate activation inputs are required, it is impossible for the user to partially activate the release mechanism (i.e., once the key is inserted, it cannot be removed without being in the home position). This ensures that the device is always in the safe mode, given the release link 514 and drive flange segment 574 (pawl release lever, also referred to as latch release mechanism) are spaced out of possible engagement along different planes from one another. As such, and inertial movements between the two components 514, 574 will not result in inadvertent actuation of the latch.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A latch assembly for a motor vehicle, comprising:

a ratchet moveable between a striker release position and a striker capture position;

a ratchet biasing member biasing said ratchet toward said striker release position;

a pawl moveable between a ratchet checking position to hold said ratchet in said striker capture position and a ratchet release position to permit movement of said ratchet to said striker release position;

a pawl biasing member biasing said pawl toward said ratchet checking position;

a latch release mechanism operable in a latch lock mode to locate said pawl in said ratchet checking position and operable in a latch release mode to locate said pawl in said ratchet release position;

a power-operated actuation mechanism operable to shift said latch release mechanism from said latch lock mode into said latch release mode; and a mechanical key cylinder release mechanism operable in a lock mode to maintain said latch release mechanism in said latch lock mode and in an unlock mode to shift said latch release mechanism into its latch release mode, said key cylinder release mechanism having a key cylinder requiring at least two distinct actuation inputs via a key to move a release link from a lock position out of operable contact with said latch release mechanism to an unlock position to operably shift said latch release mechanism into said latch release mode.

2. The latch assembly of claim 1, further including a rod operably coupling said key cylinder to said release link, said rod being moveable in a first direction during at least one of said at least at least two distinct actuation inputs and being moveable in a second direction opposite said first direction during at least one of said at least at least two distinct actuation inputs to return said release link to said lock position.

3. The latch assembly of claim 2, wherein said key cylinder is configured for insertion of the key therein and removal of the key therefrom only while said mechanical key cylinder release mechanism is in said lock mode.

4. The latch assembly of claim 2, wherein said release link is configured to move into said unlock position during movement of said rod along said second direction.

5. The latch assembly of claim 4, wherein said release link is configured to move into said lock position during movement of said rod along said second direction.

6. The latch assembly of claim 2, wherein said release link is configured to slide generally along said first direction during movement of said rod along said first direction and to slide generally along said second direction during movement of said rod along said second direction.

7. The latch assembly of claim 1, wherein said release link has a side with a guide slot formed therein, said guide slot receiving a stationary guide pin therein to facilitate moving said release link between said lock position and said unlock position.

8. The latch assembly of claim 7, wherein said guide slot is circuitous.

9. The latch assembly of claim 8, wherein said guide slot has a lower guide segment and an upper guide segment with a spring member biasing said release link upwardly to locate said stationary guide pin in said lower guide segment and downwardly to locate said stationary guide pin said upper guide segment.

10. The latch assembly of claim 9, wherein said spring member is formed as a monolithic piece of material with said release link.

11. The latch assembly of claim 2, further including a release lever operably coupling said rod to said release link, said release lever being pivotal from a non-actuated position to an actuated position in response to movement of said rod.

12. The latch assembly of claim 11, further including a spring biasing said release lever toward said non-actuated position.

13. The latch assembly of claim 2, wherein the rod is moveable in the first direction in response to rotating the key cylinder from a start-of-travel position causing the release link to move from a non-coplanar relation with the latch release mechanism into coplanar relation with said latch release mechanism; and wherein the rod is moveable in the second direction opposite said first direction in response to rotating said key cylinder in a second direction opposite said first direction to an end-of-travel position coinciding with said start-of-travel position causing said release link to pivot said latch release mechanism, thereby causing the pawl to pivot to a ratchet release position to permit biased movement of a ratchet to a striker release position, thereby releasing a striker from the ratchet.

14. The latch assembly of claim 13, wherein said release link is biased from said non-coplanar relation to said coplanar relation by a spring member.

15. The latch assembly of claim 14, spring member as a monolithic piece of material with the release link.

16. The latch assembly of claim 9, wherein the release link has a side with the guide slot formed therein.

* * * * *